US011408420B2

(12) United States Patent
Hashima

(10) Patent No.: US 11,408,420 B2
(45) Date of Patent: Aug. 9, 2022

(54) STATOR AND UNIAXIAL ECCENTRIC SCREW PUMP

(71) Applicant: Heishin Ltd., Kobe (JP)

(72) Inventor: Takashi Hashima, Kobe (JP)

(73) Assignee: Heishin Ltd., Kobe (JP)

( * ) Notice: Subject to any disclaimer, the term of this patent is extended or adjusted under 35 U.S.C. 154(b) by 235 days.

(21) Appl. No.: 16/494,278

(22) PCT Filed: Mar. 15, 2018

(86) PCT No.: PCT/JP2018/010353
§ 371 (c)(1),
(2) Date: Sep. 13, 2019

(87) PCT Pub. No.: WO2018/173937
PCT Pub. Date: Sep. 27, 2018

(65) Prior Publication Data

US 2020/0080554 A1 Mar. 12, 2020

(30) Foreign Application Priority Data

Mar. 20, 2017 (JP) ..... JP2017-053825

(51) Int. Cl.
*F01C 1/10* (2006.01)
*F04C 2/10* (2006.01)
(Continued)

(52) U.S. Cl.
CPC ..... *F04C 2/1075* (2013.01); *F01C 1/101* (2013.01); *F04C 2/107* (2013.01); *F04C 15/00* (2013.01);
(Continued)

(58) Field of Classification Search
CPC ..... F04C 2/1075; F04C 15/00; F04C 2/1071; F04C 15/0003; F04C 15/0065; F01C 1/101; F01C 5/04
See application file for complete search history.

(56) References Cited

U.S. PATENT DOCUMENTS 3,499,389 A * 3/1970 Seeberger ..... F04C 2/1075 418/48
3,612,734 A * 10/1971 Dawson ..... 418/48
(Continued)

FOREIGN PATENT DOCUMENTS

JP 1978-148303 U 11/1978
JP 1991-32184 U 3/1991
(Continued)

OTHER PUBLICATIONS

ISA/JP, International Search Report dated Jun. 19, 2018 in International Application No. PCT/JP2018/010353, total 4 pages with English translation.
Intellectual Property India, Indian Office Action (with English translation) dated Aug. 13, 2021 in Indian Application No. 201937038672, 5 pages.

*Primary Examiner* — Deming Wan
(74) *Attorney, Agent, or Firm* — Masuvalley and Partners; Peter R. Martinez

(57) ABSTRACT

The present invention aims to provide a long-life stator and a uniaxial eccentric screw pump provided with the stator, which enable a comparatively extended period of use by preventing damage of the stator due to repeating of attachment and removal to/from the uniaxial eccentric screw pump.
A stator 20 includes an outer cylinder 30, and a stator main body 42 having flange-shaped gasket parts 46 and 47. The stator 20 includes fixing areas 24 and 25 to which the gasket parts 46 and 47 and the outer cylinder 30 are adhered. One or both of the outer cylinder 30 and the gasket parts 46 and 47 has a derricking part penetrating or being dented in axial
(Continued)

directions X and made into such a shape where at least part of one of the outer cylinder and the gasket parts is fitted into the other.

9 Claims, 18 Drawing Sheets

(51) Int. Cl.
*F04C 15/00* (2006.01)
*F04C 2/107* (2006.01)

(52) U.S. Cl.
CPC ..... *F04C 2/1076* (2013.01); *F04C 2240/10* (2013.01); *F04C 2240/20* (2013.01); *F04C 2240/30* (2013.01)

(56) References Cited

U.S. PATENT DOCUMENTS 3,838,949 A * 10/1974 Makino ..... F04C 2/1073 418/48
6,460,734 B1 * 10/2002 Schroeder ..... B67D 1/0079 222/383.2

FOREIGN PATENT DOCUMENTS

JP H03-032184 Y 7/1991
JP 2004-360469 A 12/2004
JP 2008-509313 A 3/2008

* cited by examiner

FIG. 13A-1
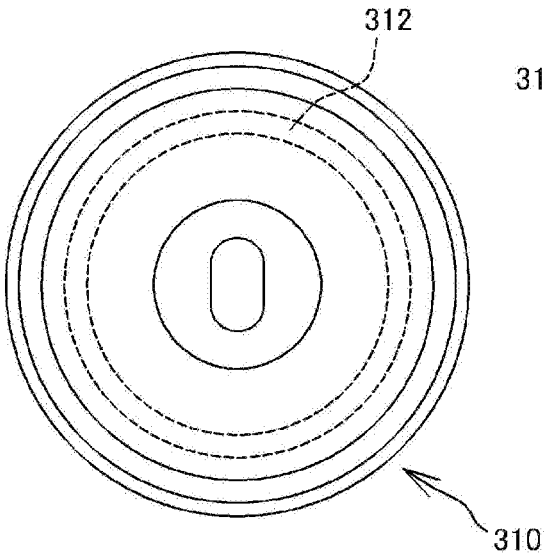
FIG. 13A-2
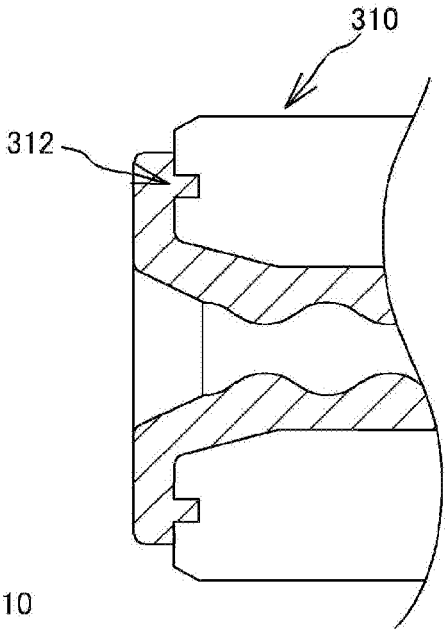
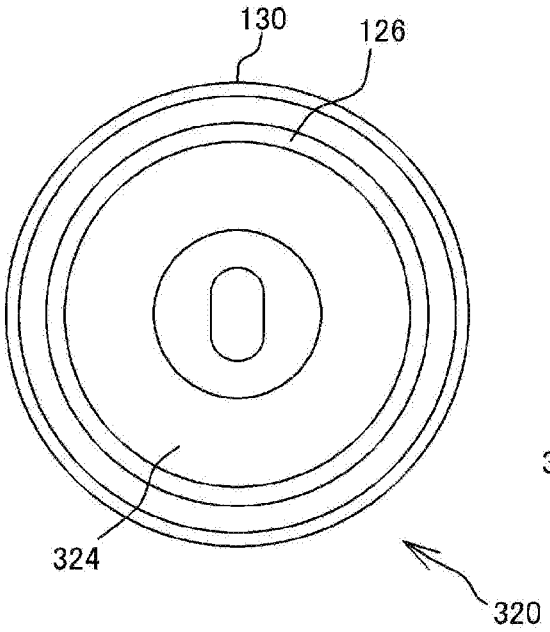
FIG. 13B-1
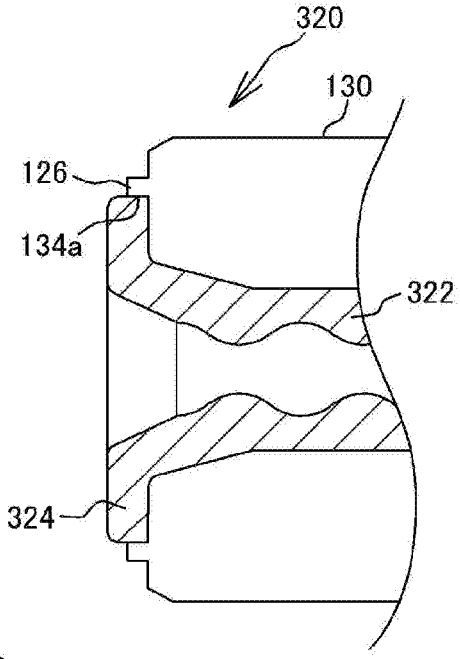
FIG. 13B-2

FIG. 14A
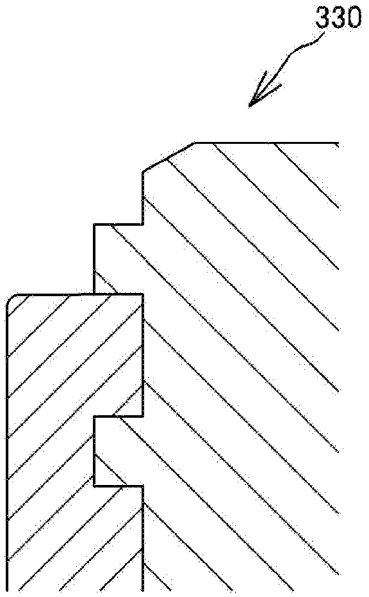
FIG. 14B
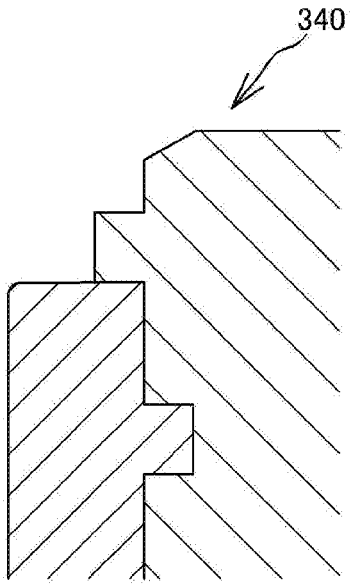
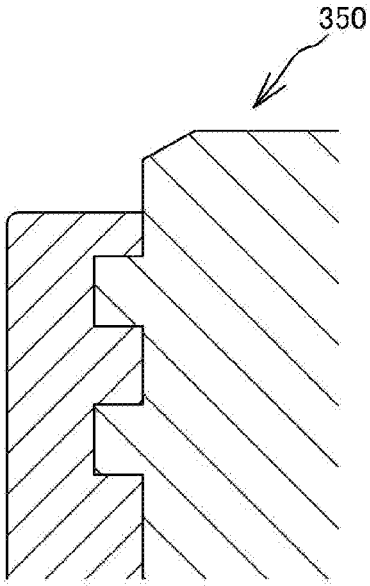
FIG. 14C
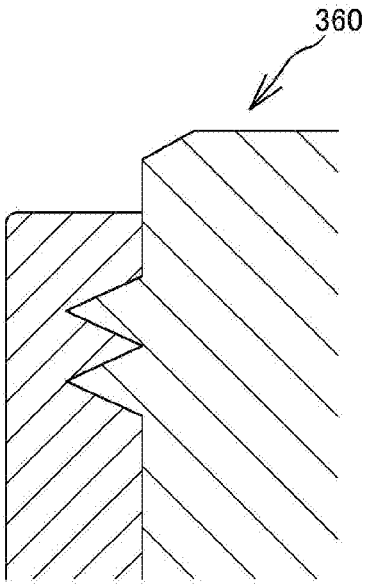
FIG. 14D

STATOR AND UNIAXIAL ECCENTRIC SCREW PUMP

This application is the U.S. National Phase of and claims priority to International Patent Application No. PCT/JP2018/010353, International Filing Date Mar. 15, 2018, entitled Stator And Uniaxial Eccentric Screw Pump; which claims benefit of Japanese Patent Application No. JP 2017-053825 filed Mar. 20, 2017; both of which are incorporated herein by reference in their entireties.

TECHNICAL FIELD

The present invention relates to a stator and a uniaxial eccentric screw pump.

BACKGROUND ART

Conventionally, a uniaxial eccentric screw pump is provided for transferring fluid substance. The uniaxial eccentric screw pump has a stator formed with an internally-threaded insertion hole, and an externally-threaded rotor which is inserted into the insertion hole of the stator and eccentrically rotates. Moreover, most of stators of the uniaxial eccentric screw pump have an outer cylinder made of a hard material such as metal, and a stator main body which is formed by molding elastomer, such as rubber or silicone and formed with the internally-threaded insertion hole. The outer cylinder and the stator main body are fixed to an inner circumferential surface of the outer cylinder by a method, such as adhesion with adhesives or pressure joining by heat.

The uniaxial eccentric screw pump provided with the stator described above is disclosed as the following Patent Document 1: JP2004-360469A which was filed by the present applicant. As illustrated in FIG. 16, a stator 520 disclosed in Patent Document 1 has an outer cylinder 530 and a stator main body 542. Gasket parts 546 and 547 are provided at both ends of the stator main body 542. The gasket parts 546 and 547 function as seal members, and capable of inhibiting that transfer liquid infiltrates into a gap between an inner circumferential surface 530*a* of the outer cylinder 530 and the stator main body 542. Moreover, in general, the outer cylinder 530 and the gasket parts 546 and 547 are fixed by adhesion with adhesives, pressure joining by heat, etc. The stator 520 is held in a state where the gasket parts 546 and 547 are pinched between an end stud 513 (nozzle) and a pump casing 516.

The stator 520 disclosed in Patent Document 1 is elastically deformed so that the gasket parts 546 and 547 expand radially due to influences etc. of the pressing force received from the end stud 513 (nozzle) etc. when attached to the uniaxial eccentric screw pump. Thus, relative positions between the gasket parts 546 and 547 and outer cylinder ends 532 and 533 deviate, and there is a concern on which large stresses act near the ends of adhesion areas A.

Describing more concretely, as illustrated in FIG. 17 etc., when attaching the stator 520 to the uniaxial eccentric screw pump, the gasket parts 546 and 547 are pinched between the members (the end studs etc.) adjacent to the outer cylinder ends 532 and 533, and are pressed from both sides in the axial directions of the stator 520. Here, by the pinching force from both sides in the axial directions of the stator 520, the gasket parts 546 and 547 are elastically deformed so as to extend radially outwardly. Moreover, when the stator 520 is removed from the pump, the gasket parts 546 and 547 are released from the pinching force from both sides in the axial directions of the stator 520, and are elastically deformed so as to contract inwardly in the radial directions.

Thus, as the attachment and removal of the stator 520 to/from the uniaxial eccentric screw pump are repeated, the action (change) of the stress accompanying the elastic deformation of the gasket parts 546 and 547 is repeated in the adhesion areas A between the gasket parts 546 and 547 and the outer cylinder 530. Thus, loads of the adhesion areas A between the gasket parts 546 and 547 and the outer cylinder 530 are accumulated, and the adhesion areas A have a concern of being damaged soon or later by peel-off, crack, etc.

When parts of the adhesion areas A peel off as described above, there is a concern in which a gap is produced between the gasket parts 546 and 547 (stator main body 542) and the outer cylinder 530. If the transfer liquid infiltrates into such a gap, the damage by peel-off, crack, etc. in the adhesion areas A spreads, and the life of the stator 520 may be shortened.

Moreover, in these days, the demand of small-sized stators for carrying a small quantity of transfer liquid has been increased. In the case of such a small-sized stator, the gasket parts and the outer cylinder are naturally reduced in the size and, thus, the adhesion areas between the gasket parts and the outer cylinder inevitably decrease to weaken the adhesiveness. Thus, in the case of the small-sized stator, there is a concern that the possibility of occurrence of the peel-off, crack, etc. in the adhesion areas A as described above further increases.

Therefore, one purpose of the present invention is to provide a long-life stator and a uniaxial eccentric screw pump provided with the stator, which enable a comparatively extended period of use by preventing damage of the stator due to repeating of attachment and removal to/from the uniaxial eccentric screw pump.

In order to solve the problem described above, a stator according to the present invention is a stator of a uniaxial eccentric screw pump structured so that an externally threaded rotor is rotatably inserted into the stator formed with an internally-threaded insertion hole, and a transferring object is transferred by eccentrically rotating the rotor via a drive source. The stator includes a stator main body, molded with elastomer, and formed in an inner circumferential surface thereof with the internally-threaded insertion hole extending in axial directions of the stator, and an outer cylinder attached externally to the stator main body. The stator main body includes a flange-shaped gasket part in at least one end thereof. The stator includes a fixing area to which the gasket part and the outer cylinder are adhered. One or both of the outer cylinder and the gasket part has a derricking part protruding or being dented in the axial directions of the stator. The derricking part is made into such a shape that at least part of one of the outer cylinder and the gasket part is fitted into the other. The derricking part and the fixing area are provided to at least one of both ends of the stator, and prevent a deformation of at least part of the gasket part due to pressing of the stator in the axial directions.

The stator of the present invention is provided with the derricking part protruding or being dented in the axial direction. Thus, the stator of the present invention is structured such that, in the derricking part, the gasket part and the outer cylinder are fitted to each other in the axial direction. Therefore, in the stator of the present invention, the fitting structure thus formed in the derricking part effectively acts on restricting a radial elastic deformation of the gasket part which is expected to occur accompanying expansion and contraction of the stator main body, etc. In this manner, according to the present invention, a deviation of the relative positions between the gasket part and the outer cylinder is prevented. Further, the stator of the present invention thereby reduces damage of the area to which the gasket part and the outer cylinder are adhered (fixing area) accompanying the elastic deformation of the gasket part. As a result, the life of the stator is prevented from being shortened.

Moreover, according to the present invention, all or part of the derricking part can be the fixing area. Thus, compared to a case where the fixing area is a flat surface like the adhesion area A of the conventional stator, the stator of the present invention expands the fixing area by expanding the area of the part where the gasket part and the outer cylinder are adjacent (contact) to each other.

The stator of the present invention is desirable to include a wall surface that forms a side surface of the derricking part provided to the end of the outer cylinder, and the wall surface is desirable to restrict the deformation in a direction intersecting with the axial directions of the stator in at least part of the gasket part.

The stator of the present invention includes the wall surface that forms the side surface of the derricking part provided to the end of the outer cylinder. Also, in the stator of the present invention, the wall surface can effectively function so as to restrict that at least the part of the gasket part deforms in the direction intersecting with the axial directions of the stator (e.g., the radial direction when the stator has a cylindrical shape. Hereinafter, "direction intersecting with the axial directions of the stator" may be referred to as "radial direction" unless otherwise specified). Therefore, the stator of the present invention reduces damage, etc. of the area to which the gasket part and the outer cylinder are adhered (fixing area) accompanying the elastic deformation of the gasket part.

The stator of the present invention is desirable to include a wall surface that forms a side surface of the derricking part provided to the end of the outer cylinder, and all or part of the wall surface is desirable to be formed so as to conform to all or part of the contour of the circumferential surface of the gasket part.

The stator of the present invention includes the wall surface that forms the side surface of the derricking part provided to the end of the outer cylinder. Also, in the stator of the present invention, all or part of the wall surface is formed so as to conform to all or part of the contour of the gasket part and, thus, the elastic deformation of the gasket part in the direction intersecting with the axial directions of the stator is restricted. Therefore, according to the present invention, the damage, etc. of the area to which the gasket part and the outer cylinder are adhered (fixing area) accompanying the elastic deformation of the gasket part is reduced.

The stator of the present invention is desirable to include a wall surface that forms a side surface of the derricking part provided to the end of the outer cylinder, and all or part of the wall surface is desirable to be arranged so as to oppose to at least part of the circumferential surface of the gasket part.

According to the structure, the wall surface is arranged to oppose to the outer side (i.e., circumferential surface) of the gasket part. Thus, the stator of the present invention efficiently restricts the radially-outward elastic deformation of the gasket part. In detail, when the gasket part is pressed in the axial directions, the radially-outside area thereof deforms greatly and large stress acts thereon. By the above structure, the stator of the present invention restricts the radially-outward elastic deformation of the gasket part in the part adjacent to the circumferential surface of the gasket part where the large stress is expected to occur.

Here, the conventional stator is structured such that the area where the gasket part formed in a substantially flat shape is joined to a substantially flat end face provided to the end of the outer cylinder (joining area) is provided (see FIG. 17). However, such a structure may become a cause to bring the damage of the joining area (e.g., peel-off of adhesives, etc.) by nails, thin instruments, etc. entering between the gasket part and the outer cylinder. Thus, it is desirable to take measures to prevent the entering other members such as the thin instruments in the part where the gasket part and the outer cylinder are adjacent to each other.

In view of the above described problems, the stator of the present invention is desirable to include a wall surface that forms a side surface of the derricking part provided to the end of the outer cylinder, and all or part of the wall surface is desirable to be arranged so as to surround the circumferential surface of the gasket part.

According to the structure, in the part where the wall surface is arranged to surround the gasket part, it is prevented that nails, thin instruments, etc. enter between the gasket part and the outer cylinder. Thus, the possibility of occurrence of an unexpected defect, such as the peel-off, crack, etc. in the joining part of the gasket part and the outer cylinder, is reduced.

Further, when structured as above, the radial elastic deformation of the gasket part in the part where the wall surface is arranged to surround the gasket part is restricted. Moreover, when being structured as above, it becomes possible to adhere the circumference of the gasket part and the wall surface, and the area to which the gasket part and the outer cylinder are adhered (fixing area) is further increased in size. Thus, the gasket part and the outer cylinder are adhered more firmly.

Additionally, structuring the stator of the present invention as above is preferable in a case of molding the stator main body using a die. In detail, when molding the stator main body using the die, a process of removing the die is performed. At the time, if removing the die while the gasket part is adhering to the die, the gasket part is pulled by the die and it may become a cause of occurrence of peel-off, etc. in the fixing area. However, the stator of the present invention is structured with the part where the wall surface is arranged to surround the gasket part as described above. Thus, according to the structure, the contact area between the part forming the gasket and the die becomes smaller by the area of the part provided with the wall surface around in the circumferential surface of the gasket part. Therefore, according to the present invention, even in a case where the stator main body is molded with the die, the stator which can be manufactured without occurrence of peel-off, etc. in the fixing area, is provided.

The stator of the present invention is desirably structured to include a wall surface that forms a side surface of the derricking part provided to the end of the outer cylinder, and an accommodation area structured inside the wall surface. All or part of the wall surface is desirable to be arranged so as to surround the circumferential surface of the gasket part, and the gasket part is desirable to have a part accommodated in the accommodation area, and a part protruded in the axial direction of the stator from the accommodation area.

According to the structure, by interposing the part of the gasket part protruded in the axial direction of the stator from the accommodation area (hereinafter, may also be referred to as the "protruding part") between another member which is the object to be joined, sufficient sealing performance with respect to the object to be joined is secured. In detail, when attaching the stator of the present invention to a uniaxial eccentric screw pump, by interposing the protruding part of the gasket part between the other member which is the object to be joined (e.g., a member referred to as the end stud, etc.), it can effectively act in securing the sealing performance.

Similar to the above described structure, with the stator of the present invention, the part where the wall surface is arranged to surround the gasket part exists. Thus, it is prevented that nails, thin instruments, etc. enter between the gasket part and the outer cylinder, and the occurrence of an unexpected defect accompanying the peel-off, etc. in the joining part of the gasket part and the outer cylinder, is reduced.

Further, by providing the wall surface descried above, the radial elastic deformation of the gasket part in the part where the wall surface is arranged is restricted. Moreover, by the wall surface adhering between the gasket part and the outer cylinder, the wall surface can be utilized to expand the fixing area of the gasket part and the outer cylinder. Therefore, according to the present invention, the gasket part and the outer cylinder are adhered more firmly.

Additionally, the present invention is effective when manufacturing a high quality stator in a case where the stator main body is molded with the die. In detail, in the stator of the present invention, the part where the wall surface is arranged to surround the gasket part exists, and the contact area between the part forming the gasket and the die becomes smaller by the amount. Therefore, according to the present invention, even in a case where the stator main body is molded with the die, the high quality stator can be provided without the peel-off, etc. in the fixing area.

As for the stator of the present invention, the derricking part provided to the end of the outer cylinder may be the outer cylinder end having a step in the axial direction of the stator.

According to the structure, the radial elastic deformation of the gasket part is restricted.

As for the stator of the present invention, the derricking part provided to the end of the outer cylinder may be provided with one or both of a concave part formed in a concave in the axial direction of the stator and a convex part formed in a convex.

According to the structure, by the convex part and the concave part forming the derricking part, the fitting structure is provided to the gasket part and the outer cylinder end part.

As for the stator of the present invention, the gasket part and the outer cylinder are desirable to be fixed by adhesion with adhesives or pressure joining by heat.

In the stator of the present invention, by having the above described structure in which the gasket part and the outer cylinder are fitted to each other in the axial direction in the derricking part, the radial elastic deformation of the gasket part is restricted. Thus, the stator of the present invention can be used stably without excess force acting on the adhering part or pressure joining part between the gasket part and the outer cylinder even in a situation where the radial elastic deformation of the gasket part, etc. may occur.

A uniaxial eccentric screw pump of the present invention includes the stator of the present invention described above.

According to the present invention, the uniaxial eccentric screw pump provided with the long-life stator can be provided.

According to the present invention, the long-life stator and the uniaxial eccentric screw pump provided with this stator, which enable the comparatively extended period of use, can be provided by preventing the damage of the stator due to the repeating of attachment and removal to/from the uniaxial eccentric screw pump.

BRIEF DESCRIPTION OF DRAWINGS

FIG. 2A is a front view, and FIG. 2B is a side cross-sectional view.

FIG. 3A is a perspective view, and FIG. 3B is a side cross-sectional view.

FIG. 8A is a front view, and FIG. 8B is a side cross-sectional view.

FIG. 9A is a perspective view, and FIG. 9B is a side cross-sectional view.

FIG. 12A is a wall surface which is substantially perpendicular to a bottom surface, FIG. 12B is a wall surface which makes an obtuse angle to the bottom surface, and FIG. 12C is one example of a wall surface which makes an acute angle to the bottom surface.

FIGS. 13A-1 through 13B-2 modifications of the derricking part of the stator of the present invention, where FIG. 13A-1 is a front view of the stator provided with a derricking part which is a concave part of a circumferential groove, FIG. 13A-2 is a cross-sectional view illustrating a substantial part of the stator of FIG. 13A-1, FIG. 13B-1 is a front view of the stator provided with a derricking part which is an annular convex part, and FIG. 13B-2 is a cross-sectional view illustrating a substantial part of the stator of FIG. 13B-1.

FIG. 14A through 14D modifications of the derricking part of the stator of the present invention, wherein FIG. 14A is a derricking part having a plurality of convex parts, FIG. 14B is a derricking part having a concave part and a convex part, FIG. 14C is a derricking part having a plurality of convex parts, and FIG. 14D is a derricking part in which two wall surfaces make an acute angle.

FIGS. 15A through 15C modifications of the derricking part of the stator of the present invention, wherein FIG. 15A is a derricking part having a shape in which the annular shape is partially divided, FIG. 15B is a derricking part having a polygonal shape, and FIG. 15C is one example in which an oval derricking part is provided to the stator having an oval outer cylinder.

MODES FOR CARRYING OUT THE INVENTION

Hereinafter, a uniaxial eccentric screw pump 10 and a stator 20 according to one embodiment of the present invention will be described in detail with reference to the drawings. Note that, although the uniaxial eccentric screw pump 10 has a feature in the stator 20, the entire structure is described in the following, prior to description of the stator 20.

«Entire Structure of Uniaxial Eccentric Screw Pump 10»

Figure 1:
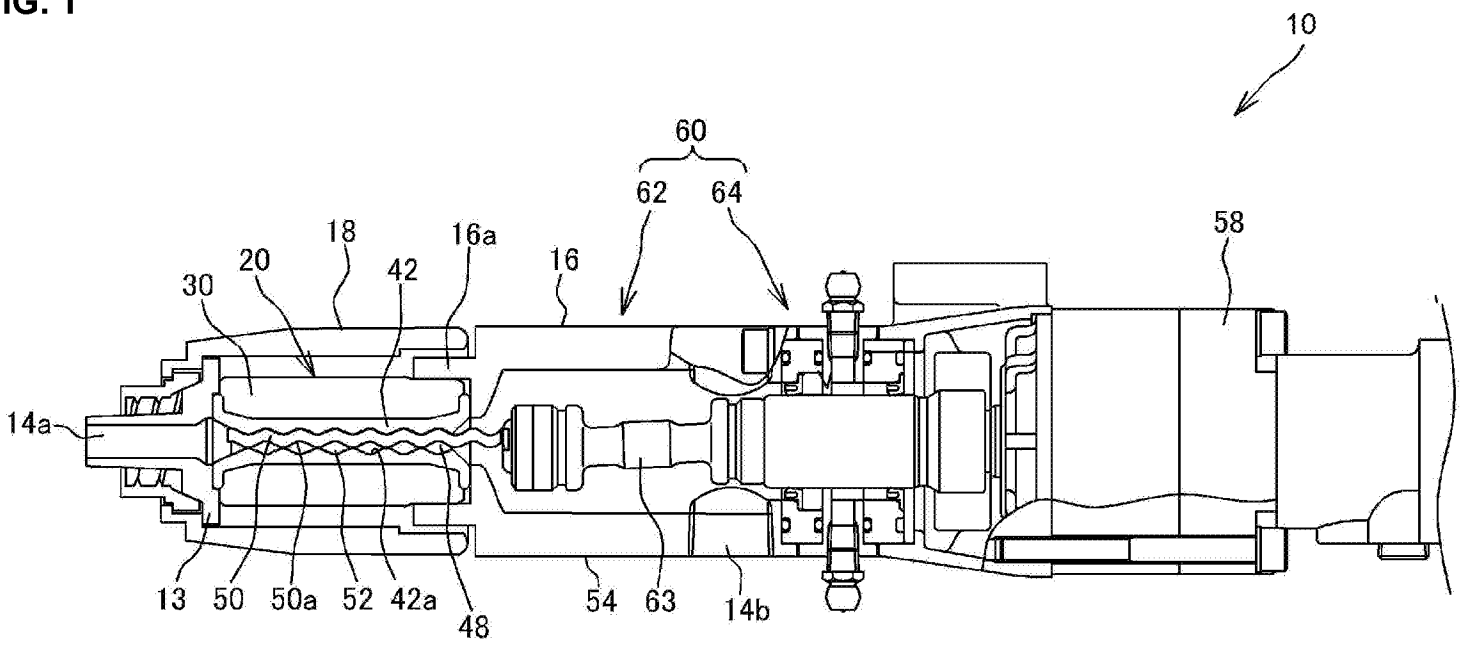
FIG. 1 is a cross-sectional view of a uniaxial eccentric screw pump provided with a stator according to a first embodiment of the present invention.

The uniaxial eccentric screw pump 10 is a so-called rotary displacement pump. As illustrated in FIG. 1, the uniaxial eccentric screw pump 10 is structured such that a rotor 50, the stator 20, and a power transmission mechanism 60, etc. are accommodated in a pump casing 16 and a stator casing 18. More specifically, the uniaxial eccentric screw pump 10 is structured such that the power transmission mechanism 60 etc. is accommodated in the pump casing 16, while the stator 20 and the rotor 50, etc. are accommodated in the stator casing 18.

The pump casing 16 is a cylindrical member made of metal, and is provided at one end side in the longitudinal directions with a stator attaching part 16*a*. Moreover, the stator casing 18 is provided at an end stud 13 attached to one end side in the longitudinal directions with a first opening part 14*a*. Moreover, a second opening part 14*b* is provided to the outer circumferential part of the pump casing 16. The second opening part 14*b* communicates with an interior space of the pump casing 16 in an intermediate part in the longitudinal directions of the pump casing 16.

The first opening part 14*a* and the second opening part 14*b* are parts which function as a discharge port and a suction port of the uniaxial eccentric screw pump 10, respectively. The uniaxial eccentric screw pump 10 makes the first opening part 14*a* function as the discharge port and the second opening part 14*b* as the suction port by rotating the rotor 50 in the positive direction. Alternatively, it makes the first opening part 14*a* function as the suction port and the second opening part 14*b* as the discharge port by rotating the rotor 50 in the opposite direction for maintenance etc. to clean up the interior space etc. of the pump casing 16.

The stator 20 is accommodated in the stator casing 18 in a state where one end thereof is adjacent to the end stud 13 and the other end is fitted into the stator attaching part 16*a* of the pump casing 16.

The stator 20 is a member having the appeared shape of a substantially cylindrical shape. The stator 20 has a cylindrical outer cylinder 30 made of metal, and a stator main body 42 made of elastic material such as rubber, or elastomer such as resin. The stator 20 is structured so that the stator main body 42 is formed inside the outer cylinder 30.

The stator main body 42 accommodates a cylindrical part 44 (described below) in the outer cylinder 30. The outer diameter of the stator main body 42 is substantially the same as the inner diameter of the outer cylinder 30. Thus, the stator main body 42 is attached in a state where the outer circumferential surface thereof substantially closely contacts an inner circumferential surface 30*a* of the outer cylinder 30, and is formed integrally by a fixing means, such as adhesives. As illustrated in FIG. 1, an insertion hole 48 is formed in the stator main body 42, and an inner circumferential surface 42*a* is made into an internal-thread shape with n grooves and a single twist or multiple twists. In this embodiment, as for the insertion hole 48, the inner circumferential surface 42*a* is made into an internal-thread shape with two grooves and multiple twists. Note that the structure of the stator 20 will be described in detail later.

The rotor 50 is a shaft body made of metal, and is made into an external-thread shape with n−1 grooves and single twist or multiple twists. In this embodiment, the rotor 50 is made into an eccentric external-thread shape with one groove. The rotor 50 has a substantially perfect circular cross-sectional shape at any position in the longitudinal directions. The rotor 50 is inserted into the insertion hole 48 formed in the stator main body 42 described above, and is eccentrically rotatable inside the insertion hole 48.

When the rotor 50 is inserted into the stator 20, an outer circumferential wall 50*a* of the rotor 50 and the inner circumferential surface 42*a* of the stator main body 42 become in a state where they closely contact at their tangent lines, and a fluid conveying path 52 (cavity) is formed between the inner circumferential surface 42*a* of the stator main body 42 and the outer circumferential wall 50*a* of the rotor 50. The fluid conveying path 52 spirally extends in the longitudinal directions of the stator 20 and the rotor 50.

When rotating the rotor 50 inside the insertion hole 48 of the stator main body 42, the fluid conveying path 52 advances in the longitudinal direction of the stator 20 while rotating inside the stator main body 42. Thus, when the rotor 50 is rotated, fluid is sucked into the fluid conveying path 52 from one end side of the stator 20, is carried toward the other end side of the stator 20 in a state where the fluid is trapped inside the fluid conveying path 52, and is discharged at the other end side of the stator 20.

The power transmission mechanism 60 is to transmit a motive force from a drive source 58 to the rotor 50 described above. The power transmission mechanism 60 has a power transmitting part 64 and an eccentrically rotating part 62. The power transmitting part 64 is provided at one end side in the longitudinal directions of the pump casing 16. Moreover, the eccentrically rotating part 62 is provided to an intermediate part 54. The eccentrically rotating part 62 is a part which connects the power transmitting part 64 with the rotor 50 so as to be power-transmittable. The eccentrically rotating part 62 is provided with a coupling shaft 63 comprised of a conventionally-known coupling rod, a screw rod, etc. Thus, the eccentrically rotating part 62 is capable of transmitting to the rotor 50 the rotational driving force generated by actuating the drive source 58 to eccentrically rotate the rotor 50.

«Structure of Stator 20»

Figure 2B:
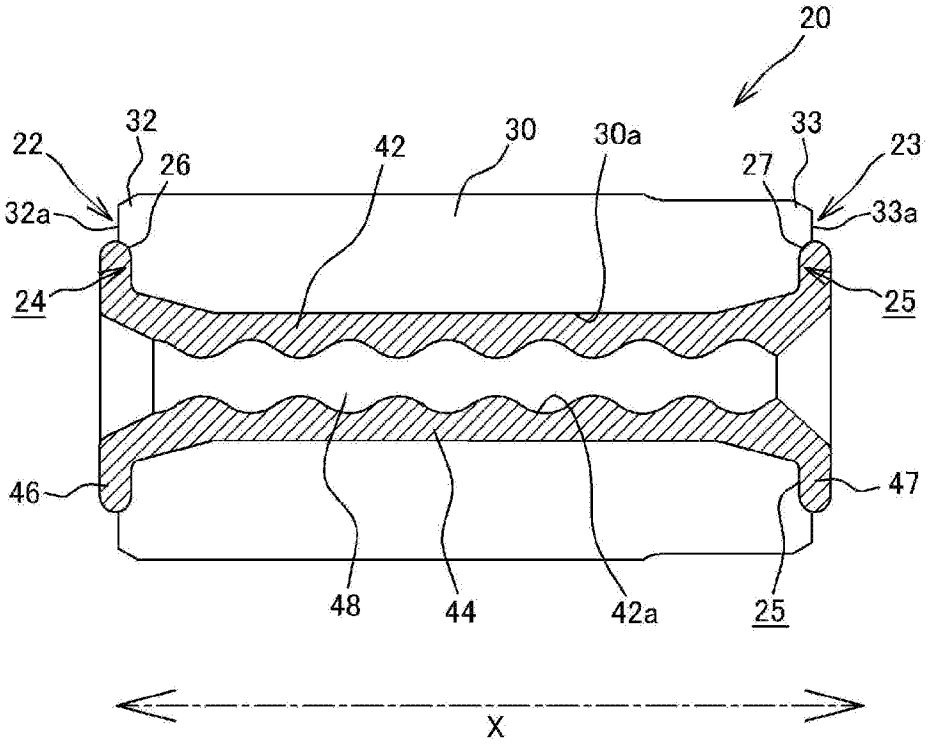
FIGS. 2A-2B illustrate a stator according to the first embodiment of the present invention, where

Below, the stator 20 of the present invention is described in detail. As illustrated in FIG. 2B, the stator 20 of the present invention includes the outer cylinder 30 and the stator main body 42.

Note that, in the following description, the axial directions of the stator 20 (longitudinal directions) is described referring to as "axial directions X." Moreover, a state where the stator 20 is viewed in the axial direction X from the end stud 13 side is described referring to as "the front view."

The stator 20 is structured such that the outer cylinder 30 is attached externally to the stator main body 42. The stator 20 is formed by integrating the outer cylinder 30 and the stator main body 42, for example, with a technique, such as pouring molding material of the stator main body 42 into the outer cylinder 30 to which adhesives are adhered. Note that the molding of the stator main body 42 will be described later.

As illustrated in FIG. 2B, the stator 20 has stator ends 22 and 23 at both ends in the axial directions X. The stator ends 22 and 23 are provided with fixing areas 24 and 25, respectively. Moreover, the outer cylinder 30 has outer cylinder ends 32 and 33 at both ends in the axial directions X. The stator main body 42 has flange-shaped gasket parts 46 and 47 on both sides in the longitudinal directions. The stator 20 has the fixing areas 24 and 25 in a contact part between the outer cylinder ends 32 and 33 and the gasket parts 46 and 47, respectively. The stator 20 is structured such that the outer cylinder ends 32 and 33 are fixed to the gasket parts 46 and 47 by adhesives etc. in the fixing areas 24 and 25, respectively.

Moreover, the stator 20 has derricking parts 26 and 27. The derricking parts 26 and 27 are concave parts formed at both ends of the outer cylinder ends 32 and 33, respectively. The stator 20 is structured such that the gasket parts 46 and 47 are inserted (or penetrated) into the outer cylinder ends 32 and 33 in the axial directions X to the outer cylinder ends 32 and 33, respectively. In the stator 20 of this embodiment, the derricking part 26 and the fixing area 24 are provided to the stator end 22. Moreover, in the stator 20, the derricking part 27 and the fixing area 25 are provided to the stator end 23.

As illustrated in FIG. 2B, the outer cylinder 30 is a hollow cylindrical member made of metal. As described above, the outer cylinder 30 is attached externally to the stator main body 42. Note that, as for the material of the outer cylinder 30, hard material may be suitably selected. For example, as the material of the outer cylinder 30, material, such as resin, may be selected.

The outer cylinder 30 of this embodiment is a cylindrical body having a substantially circular cross-section. As illustrated in FIG. 3, the outer cylinder 30 has a through-hole 40 penetrating in the axial directions X. The stator main body 42 is accommodated in the outer cylinder 30 so as to substantially closely contact the inner circumferential surface 30*a* of the through-hole 40.

Note that, although the outer cylinder 30 has the substantially cylindrical appearance, it may be any kind of shapes, as long as it conforms to the shape of the stator main body 42. For example, the outer cylinder 30 may have a substantially oval cross-sectional shape (see FIG. 15(*c*)), or a substantially triangular cross-sectional shape.

As illustrated in FIG. 2B, in the outer cylinder 30, the derricking parts 26 and 27 (concave parts) are provided to the outer cylinder ends 32 and 33, respectively. The derricking part 26 is provided to the outer cylinder end 32 on the end stud 13 side, and the derricking part 27 is provided to the outer cylinder end 33 on the pump casing 16 side. In this embodiment, since the gasket parts 46 and 47 are made into the substantially circular shape in the front view, the derricking parts 26 and 27 are made into the concave parts having the substantially circular shape in the front view. Note that the derricking parts 26 and 27 are structured similarly. Thus, in the following description, the derricking part 26 is described in detail, while description of the derricking part 27 is omitted.

Figure 2A:
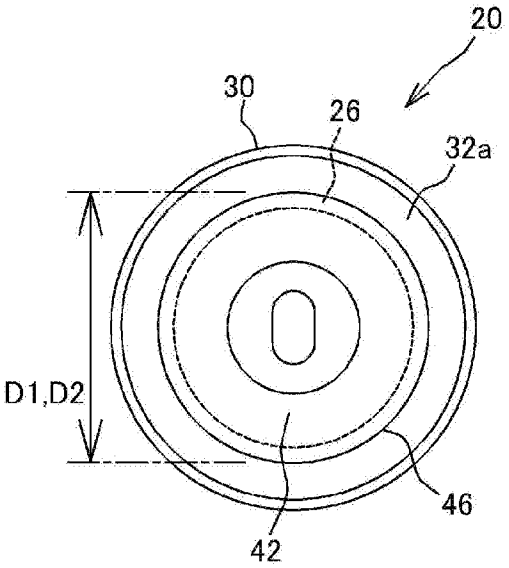
Figure 3A:
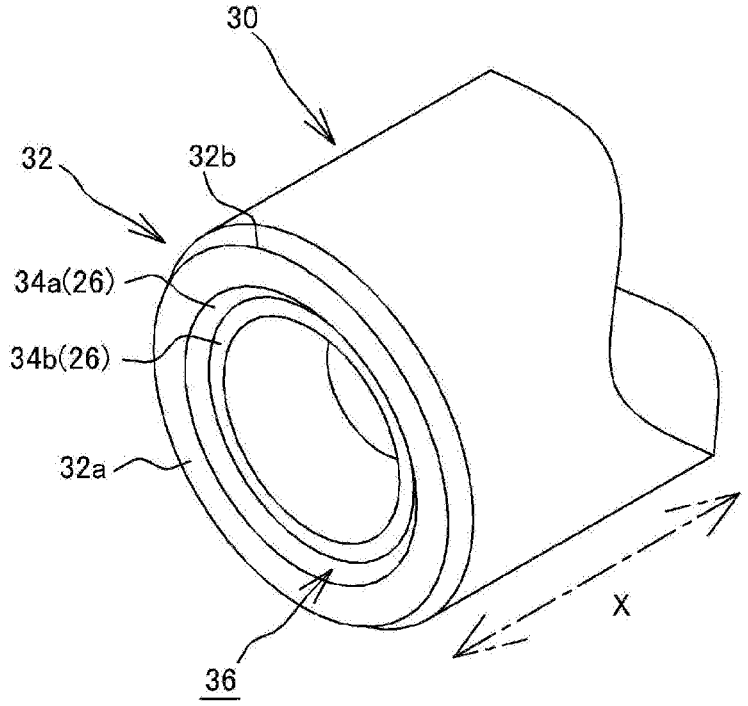
FIGS. 3A-3B an outer cylinder substantial part of the stator of FIGS. 2A-2B, where

As illustrated in FIG. 3A, the derricking part 26 (concave part) is formed as a substantially circular depression which is dented in the axial direction X from an end face 32*a* of the outer cylinder end 32. Moreover, as illustrated in FIG. 2A, the derricking part 26 has a substantially circular contour having a diameter D1 which conforms to the entire outer circumference of the outer cylinder 30 in the front view. Thus, the derricking part 26 is made into the size and shape to which the gasket part 46 of the stator main body 42 can be fitted without a substantial gap. In other words, the derricking part 26 is provided to be such a shape in order to protrude (penetrate) the gasket part 46 of the stator main body 42 toward the center side in the axial directions X rather than the end face 32*a* of the outer cylinder end 32, and part of the gasket part 46 is fitted into the outer cylinder 30.

Figure 3B:
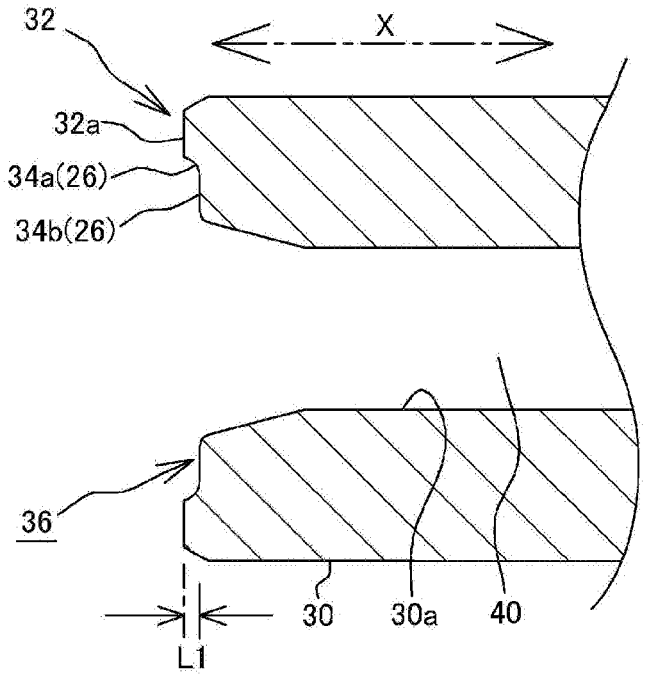

As illustrated in FIGS. 3A and 3B, the concave part which forms the derricking part 26 forms a step in the outer cylinder end 32. More specifically, the derricking part 26 has a bottom surface 34*b* which is dented from the end face 32*a* in the axial direction X by a distance L1, and is made into a shape in which the step is formed between the end face 32*a* and the bottom surface 34*b*.

As illustrated in FIGS. 3A and 3B, the derricking part 26 has a wall surface 34*a* which forms a side surface (inner circumferential surface). More specifically, the derricking part 26 has the wall surface 34*a* which expands in the axial direction X, between the end face 32*a* and the bottom surface 34*b*. The wall surface 34*a* is made into the shape which is curved by so-called rounding etc. The bottom surface 34*b* is a surface which is substantially parallel to the end face 32*a*, and is formed so as to be surrounded by the wall surface 34*a*. The derricking part 26 has an accommodation area 36 where the gasket part 46 is capable to be accommodated inside the wall surface 34*a*.

As illustrated in FIG. 2B, the stator main body 42 is the cylindrical member where the cylindrical part 44 and the gasket parts 46 and 47 are integrally formed. The insertion hole 48 of the internal-thread shape described above is formed in the stator main body 42 so as to extend in the axial directions X. The stator main body 42 is formed of appropriate material, for example, rubber such as nitrile rubber, ethylene propylene rubber, or fluoride rubber, or elastomer with elasticity such as silicone. Moreover, the stator main body 42 is fixed to the outer cylinder 30 with, for example, a molding technique of flowing molding material into the outer cylinder 30 to which adhesives are adhered.

The cylindrical part 44 has tapered parts where the diameter increases gradually near both ends. The gasket parts 46 and 47 are formed on both sides of the cylindrical part 44, and are made into the flange shape. Moreover, as illustrated in FIG. 2A, the gasket parts 46 and 47 have the substantially circular shape in the front view.

Note that the gasket part 46 and the gasket part 47 have a similar structure. Thus, in the following description, the gasket part 46 is described in detail, and description of the gasket part 47 is omitted.

As illustrated in FIG. 2B, the gasket part 46 is the flange-shaped part which is expanded radially outwardly in the end of the stator main body 42. As illustrated in FIG. 2A, the gasket part 46 is made into the appearance of the substantially circular shape having a diameter D2 in the front view. The diameter D2 of the gasket part 46 is in substantially agreement with the diameter D1 of the derricking part 26. Further, as illustrated in FIG. 4, the gasket part 46 has the thickness of a distance L2 in the axial directions X.

Figure 4:
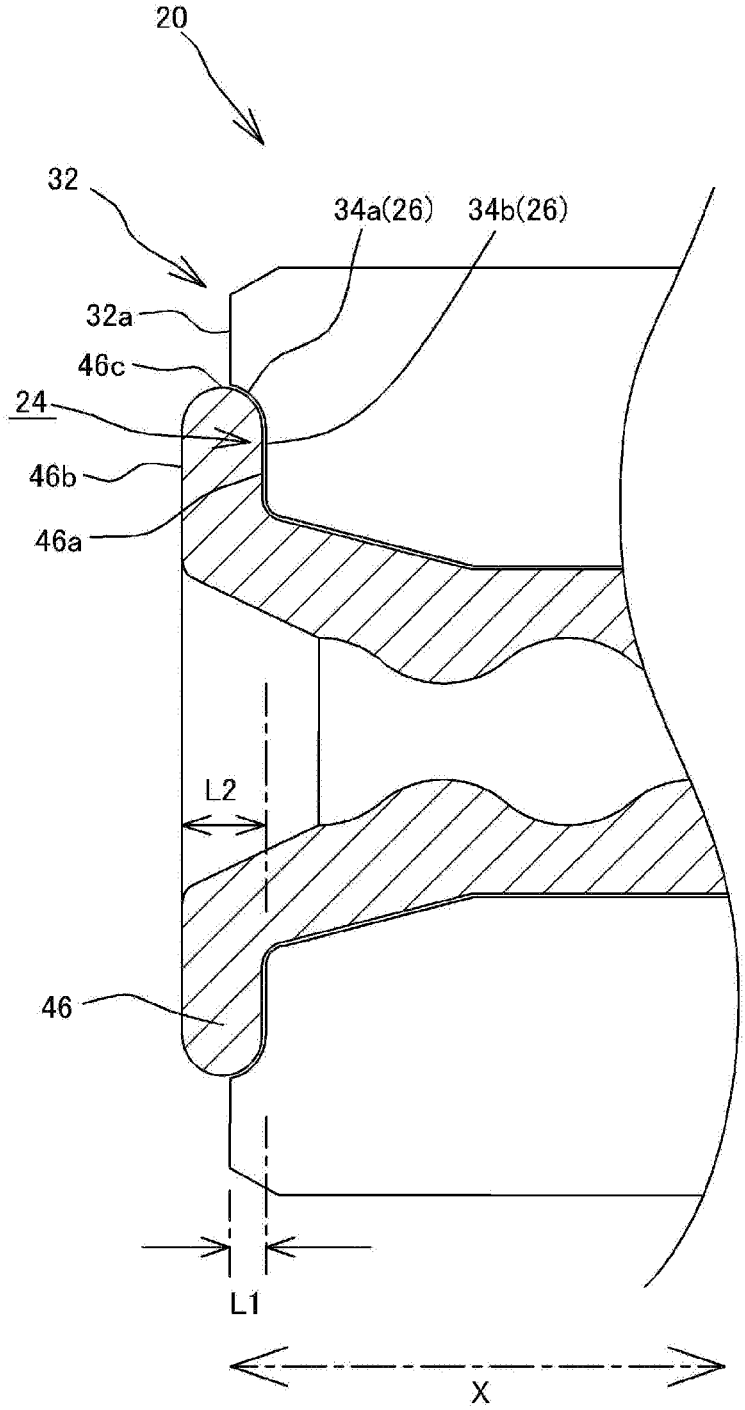
FIG. 4 is a cross-sectional view illustrating a substantial part of the stator of FIGS. 2A-2B.

As illustrated in FIG. 4, the gasket part 46 has an adhesion surface 46*a*, a sealing surface 46*b*, and a circumferential surface 46*c*. The adhesion surface 46*a* is a surface adhered to the end face 32*a* of the outer cylinder 30, and is adjacent (opposes) to the end face 32*a* of the outer cylinder 30. Moreover, the sealing surface 46*b* is a surface formed at a tip end of the stator main body 42. The adhesion surface 46*a* and the sealing surface 46*b* are formed to be a substantially flat surface. Moreover, the circumferential surface 46*c* is formed to be a curved surface which conforms to the curved shape of the wall surface 34*a*. Specifically, the circumferential surface 46*c* is formed to be the curved surface of which a substantially center in the axial directions X is radially bulged.

Next, an outline of a procedure to form the stator main body 42 in the outer cylinder 30 of this embodiment, and a damage control of the gasket parts 46 and 47 when molding the stator main body 42, are described.

When molding the stator main body 42 onto the outer cylinder 30, adhesives are first adhered to the inner circumferential surface 30*a* and the outer cylinder ends 32 and 33 of the outer cylinder 30. Next, the outer cylinder 30 is inserted into a given die M, and an internally-threaded core (not illustrated) is placed inside the outer cylinder 30. Next, elastomer used as the forming material of the stator main body 42 is poured therein. Thus, the stator main body 42 having the internally-threaded insertion hole 48 and the gasket parts 46 and 47 is molded in a state where it is adhered to the outer cylinder 30.

Figure 5:
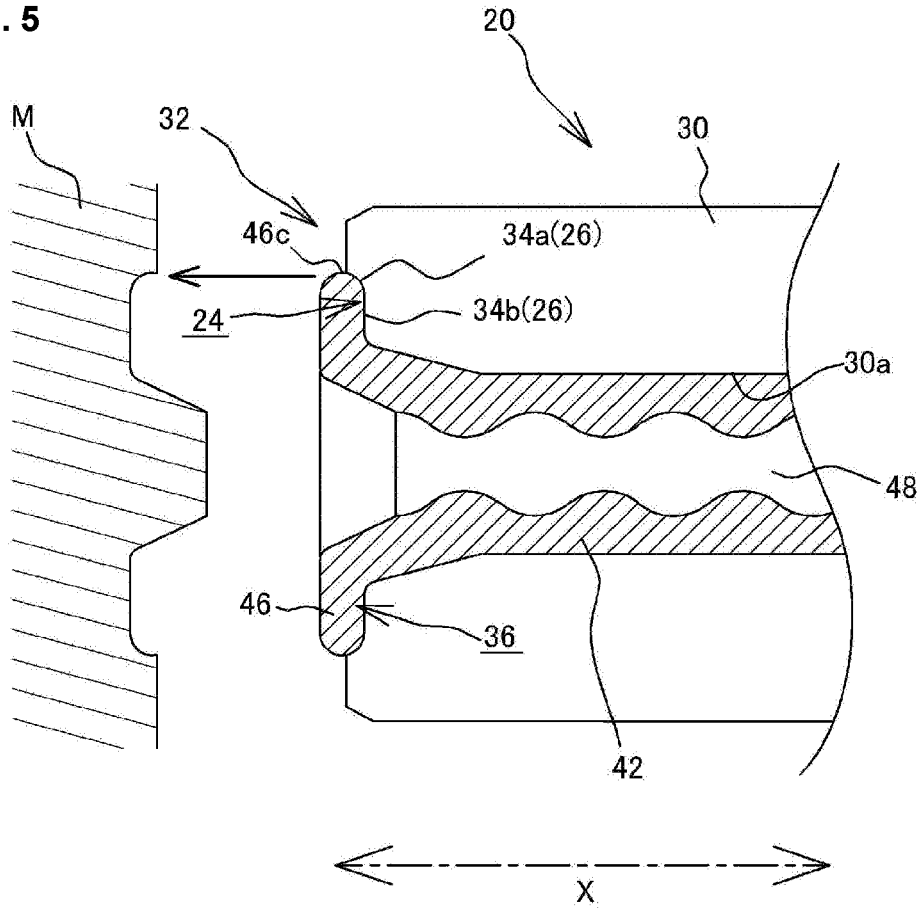
FIG. 5 is a cross-sectional view illustrating the stator of FIGS. 2A-2B when released from a mold in a molding process.

As illustrated in FIG. 5, after the above-described process is finished, the die M is removed from the stator 20, and the core (not illustrated) is then taken out. During the process of removing the die M, a pulling force (see an arrow in FIG. 5) acts in a separating direction from the die M on the gasket parts 46 and 47 which are molded products by being pulled by the die M.

Here, the stator 20 of this embodiment is molded so as to be in a state where part of the gasket part 46 is fitted into the derricking part 26 of the outer cylinder 30. More specifically, the gasket part 46 becomes in a state where part of the circumferential surface 46*c* in the axial directions X is fitted into the accommodation area 36. Moreover, parts other than the part accommodated in the accommodation area 36 of the gasket part 46 are formed in a state where they protrude outwardly in the axial direction X from the accommodation area 36. In other words, in the molding process of the stator main body 42, the part of the circumferential surface 46*c* of the gasket part 46 is adjacently located so as to oppose to the wall surface 34*a*, and other parts become parts which contact the die M.

Further describing, as illustrated in FIG. 4 etc., in the stator 20, the gasket part 46 is fixed to the outer cylinder 30 by applying adhesives etc. to, in addition to the bottom surface 34*b* which spreads in the directions which intersect to the axial directions X (radial directions), the wall surface 34*a* formed so as to spread in the axial directions X. Thus, the stator 20 can have a larger adhesion area (fixing area) than the case where the outer cylinder 530 and the stator main body 542 are fixed only in the surface which spreads radially (end face) like the conventional stator 520. Further, the wall surface 34*a* is also a surface which intersects to the removing direction from the die M. Thus, the wall surface 34*a* is difficult to receive the influence of a stress which acts according to the removing from the die M, compared with the bottom surface 34*b*. Therefore, in the stator 20, the force caused due to the removing from the die M (pulling force) can be distributed and supported by the wall surface 34*a*, as well as by the bottom surface 34*b*. In addition, in the stator 20, since the part of the circumferential surface 46*c* of the gasket part 46 is accommodated in the accommodation area 36, the area which contacts the die M when molding becomes smaller by the area of the part. According to these effects, a problem such that the gasket part 46 is unexpectedly separated from the outer cylinder 30 under the influence of the force caused when removing from the die M upon molding of the stator 20, can be reduced.

Note that, although in the stator 20 of this embodiment, the stator main body 42 is formed by pouring the molding material of the stator main body 42 into the die M which accommodates the outer cylinder 30, but the stator of the present invention is not limited to this fabrication.

For example, the stator of the present invention may fix the stator main body 42 to the outer cylinder 30 by utilizing adhesiveness to the outer cylinder 30 which the molding material, such as elastomer, itself has, without using the intermediate material, such as adhesives. Moreover, the stator of the present invention may constitute the outer cylinder 30 by hard material made of resin, and may fix the outer cylinder 30 and the stator main body 42 by pressure with the effect of heat etc. Alternatively, the stator of the present invention may be fabricated by preparing the stator main body 42 and the outer cylinder 30 which are molded beforehand, fixing the molded stator main body 42 to the outer cylinder 30 integrally by adhesion with adhesives or pressure joining by heating. Thus, the stator of the present invention is suitably selectable of the fixing means of the outer cylinder 30 and the stator main body 42.

Next, a deformation control of the gasket parts 46 and 47 in the attachment and removal work of the stator 20 to the uniaxial eccentric screw pump 10 is described.

Figure 6:
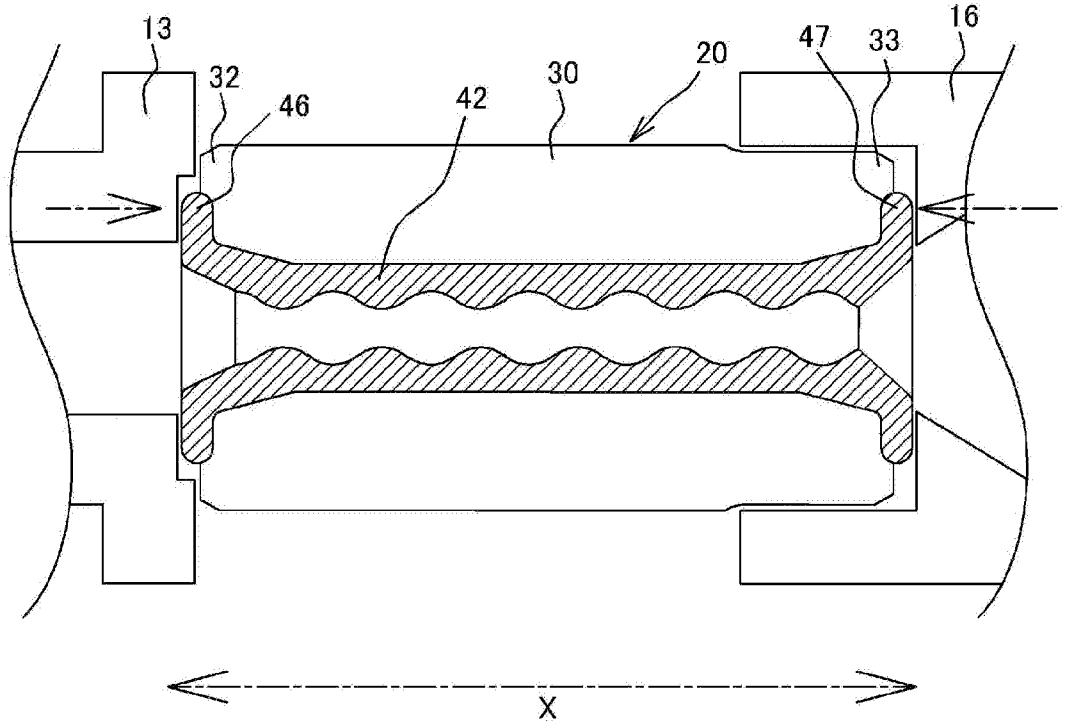
FIG. 6 is a conceptual view illustrating a state where the stator of FIGS. 2A-2B is attached to the uniaxial eccentric screw pump.

As illustrated in FIG. 6(*a*), when attaching the stator 20 to the uniaxial eccentric screw pump 10, the gasket parts 46 and 47 are pressed from both sides in the axial directions X. More specifically, when attaching the stator 20 to the uniaxial eccentric screw pump 10, the gasket part 46 is pressed from both sides in the axial directions X by being pinched between the outer cylinder end 32 and the end stud 13. Moreover, the gasket part 47 is pressed from both sides in the axial directions X by being pinched between the outer cylinder end 33 and the pump casing 16. Thus, the gasket parts 46 and 47 tend to be elastically deformed so as to expand radially outwardly (see FIG. 7).

Figure 7:
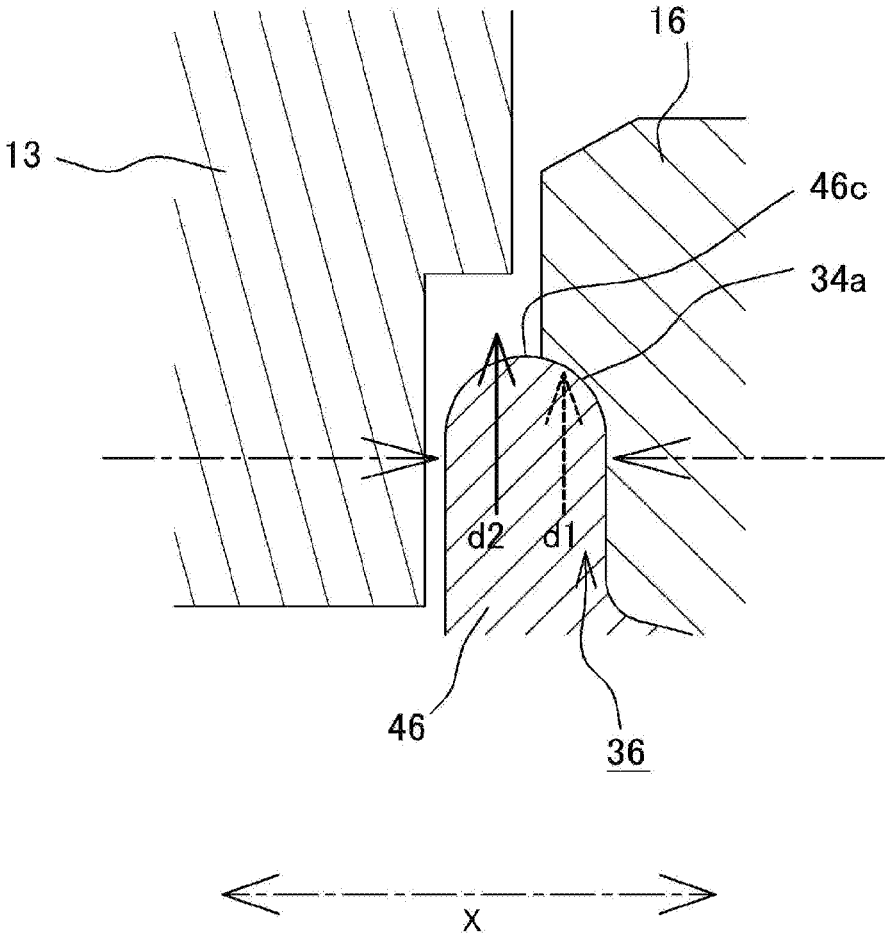
FIG. 7 is a cross-sectional view where a substantial part in FIG. 6 is enlarged.

Here, the gasket part 46 of this embodiment is molded in a state where the part of the circumferential surface 46*c* in the axial directions X is surrounded by the wall surface 34*a*. That is, the circumferential surface 46*c* of the gasket part 46 becomes in a state where it is surrounded by the wall surface 34*a*. As illustrated in FIG. 7, the part of the gasket part 46 surrounded by the wall surface 34*a* (part accommodated in the accommodation area 36) contacts the wall surface 34*a*, and its radially-outward elastic deformation is restricted (see an arrow d1 in FIG. 7). Moreover, also for the gasket part 47, the part of the gasket part 47 surrounded by the wall surface 35*a* (part accommodated in an accommodation area 37) contacts the wall surface 35*a*, and its radially-outward elastic deformation is restricted (not illustrated).

Thus, as for the stator 20, upon the attachment to the uniaxial eccentric screw pump 10, even if the pinching forces act on the gasket parts 46 and 47 from both sides in the axial directions X, at least the parts of the gasket parts 46 and 47 accommodated in the accommodation areas 36 and 37 are controlled in the radial elastic deformation. Thus, shear forces in the radial directions of the stator 20 acting on the fixing areas 24 and 25 can be inhibited. Moreover, since the gasket parts 46 and 47 are attached in a state where their radial elastic deformations are controlled, elastic deformations to contract the gasket parts 46 and 47 in the radial direction hardly take place when removing the stator 20 from the uniaxial eccentric screw pump 10. Thus, as for the stator 20, even if the pinching force acting on the gasket parts 46 and 47 upon the attachment and removal to/from the uniaxial eccentric screw pump 10 varies, the radial deformation of the gasket parts 46 and 47 hardly takes place. Therefore, as for the stator 20, a defect, such as the gasket parts 46 and 47 being peeled off from the outer cylinder ends 32 and 33, does not easily occur.

Next, a function of the gasket parts 46 and 47 as seal members, in the stator 20 of this embodiment, is described.

As illustrated in FIGS. 2A-2B and FIG. 4, as for the stator 20, the parts of gasket parts 46 and 47 are accommodated in the accommodation areas 36 and 37, other parts protrude outwardly in the axial directions X from the accommodation areas 36 and 37 (below, in the description of this embodiment, referred to as "the protruding parts"). Moreover, as illustrated in FIG. 6, in the state where the stator 20 is attached to the uniaxial eccentric screw pump 10, the protruding part of the gasket part 46 is fitted into the concave part formed in the end stud 13. The protruding part of the gasket part 47 is fitted into the concave part formed in the pump casing 16. Moreover, the parts of the gasket parts 46 and 47 accommodated in the accommodation areas 36 and 37 are restricted in their radially-outward elastic deformations by the wall surfaces 34*a* and 35*a* (see the arrow d1 in FIG. 7), while the protruding parts are permitted in the radially-outward elastic deformations to some extent (see an arrow d2 in FIG. 7). Thus, when the pressing forces act on the gasket parts 46 and 47 from both sides in the axial directions X according to the attachment of the stator 20 to the uniaxial eccentric screw pump 10, the protruding parts of the gasket parts 46 and 47 are elastically deformed radially outwardly. Thus, the gaps between the end stud 13 and the pump casing 16, and the outer cylinder 30 are filled by the protruding parts of the gasket parts 46 and 47 so that a leak of liquid or gas is inhibited. That is, the protruding parts of the gasket parts 46 and 47 function as the seal members.

As illustrated in FIG. 4 etc., as for the stator 20, the adhesion surfaces 46*a* and 47*a* of the gasket parts 46 and 47, and the bottom surfaces 34*b* and 35*b* of the outer cylinder ends 32 and 33 are all formed in substantially flat surfaces. Further, in the stator 20, the wall surfaces 34*a* and 35*a* are provided so as to surround the adhesion surfaces 46*a* and 47*a* and the bottom surfaces 34*b* and 35*b* from radially outward, respectively. Thus, even if a thin instrument etc. is used near the gasket parts 46 and 47 when the attachment-and-detachment work etc. of the stator 20, or even if a worker holds the gasket parts 46 and 47 by hand, the wall surfaces 34*a* and 35*a* will not be obstacles, and the instrument described above, nails, etc. will not enter between the adhesion surfaces 46*a* and 47*a* and the bottom surfaces 34*b* and 35*b*, respectively. Thus, the defect, such as the peel-off in the fixing areas 24 and 25, caused by the instrument etc. being caught between the adhesion surfaces 46*a* and 47*a* and the bottom surfaces 34*b* and 35*b*, respectively, can be inhibited.

Second Embodiment

Then, a stator 120 according to a second embodiment of the present invention is described. Note that, in the following description of the stator 120, similar structures to the stator 20 will be described using the same characters as those assigned in the description of the stator 20 to omit detailed description thereof.

Figure 8B:
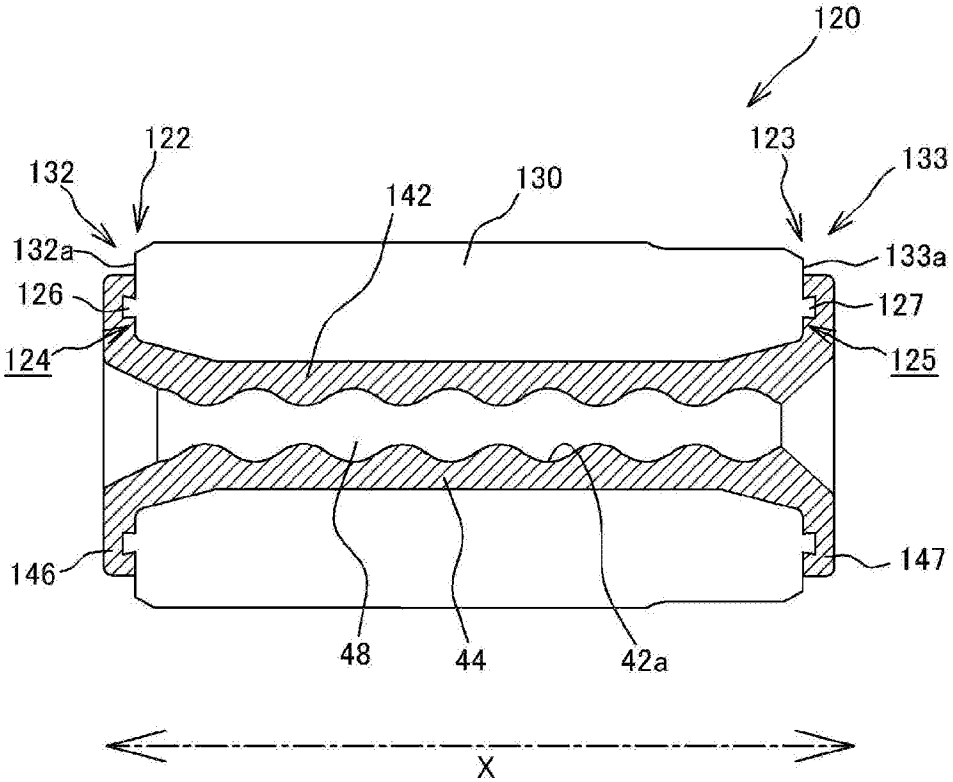
FIGS. 8A-8B illustrate a stator according to a second embodiment of the present invention, where
Figure 8A:
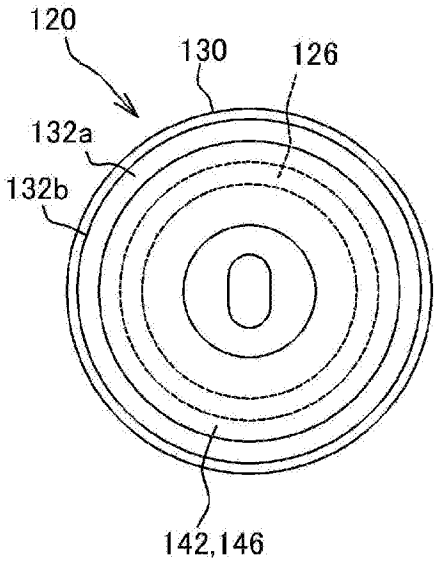

As illustrated in FIGS. 8A-8B, the stator 120 has an outer cylinder 130 and a stator main body 142. The stator main body 142 is integrally formed with flange-shaped gasket parts 146 and 147 at both sides of the cylindrical part 44. Moreover, an internally-threaded insertion hole 48 is formed in the stator main body 142. As for the stator 120, the outer cylinder 130 and the stator main body 142 are integrally formed by the technique of pouring the molding material of the stator main body 142 into the outer cylinder 130 to which adhesives are adhered, similar to the stator 20 of the first embodiment.

As illustrated in FIG. 8B, the stator 120 has stator ends 122 and 123 at both ends in the axial directions X of the outer cylinder 130. Fixing areas 124 and 125 are formed in the stator ends 122 and 123. As for the stator 120, the fixing areas 124 and 125 are constituted at the stator ends 122 and 123, respectively. Moreover, the outer cylinder 130 has outer cylinder ends 132 and 133 at both ends in the axial directions X. The stator main body 142 has flange-shaped gasket parts 146 and 147 on both sides in the longitudinal directions. The stator 120 is formed by the outer cylinder ends 132 and 133 and the gasket parts 146 and 147 are fixed by adhesives etc. in the fixing areas 124 and 125, respectively.

Moreover, the stator 120 has derricking parts 126 and 127. The derricking parts 126 and 127 are convex parts formed in the outer cylinder ends 132 and 133, respectively. The stator 120 is structured so that the derricking parts 126 and 127 provided in the outer cylinder ends 132 and 133 are fitted into the concave parts formed in the gasket parts 146 and 147 (or protruded) in the axial directions X.

As illustrated in FIG. 8B, the derricking part 126 is provided so as to protrude toward the end stud 13 from the outer cylinder end 132. Moreover, the derricking part 127 is provided so as to protrude toward the pump casing 16 from the outer cylinder end 133. Note that the derricking part 126 and the derricking part 127 are structured similarly. Thus, the derricking part 126 is described in the following description of this embodiment, and detailed description of the derricking part 127 is omitted.

As described above, the outer cylinder 130 has the derricking part (convex part) 126. The derricking part 126 of this embodiment is a convex part formed in the outer cylinder end 132. Moreover, the derricking part 126 forms in the outer cylinder end 132 a step which protrudes in the axial direction X toward the end stud 13.

Figure 9A:
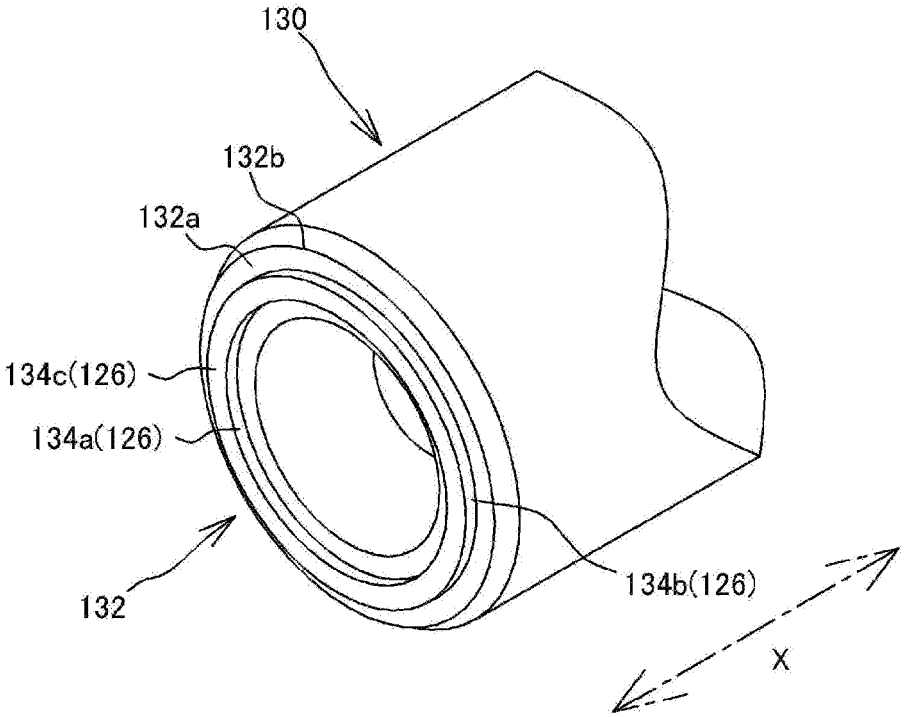
FIGS. 9A-9B illustrate an outer cylinder substantial part of the stator of FIGS. 8A-8B, where
Figure 9B:
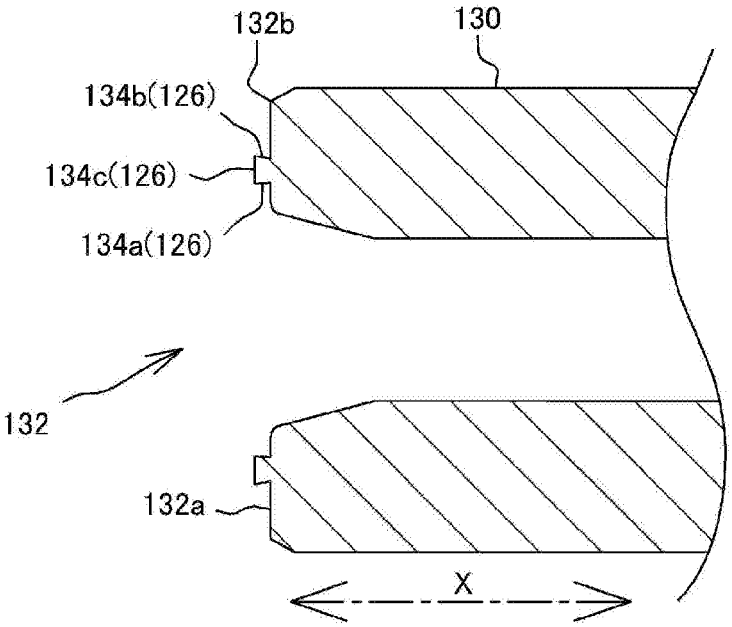

As illustrated in FIGS. 9A and 9B, the derricking part 126 of this embodiment is made into a shape which annularly protrudes from an end face 132*a* of the outer cylinder end 132. More specifically, as illustrated in FIG. 9A, the derricking part 126 is provided at a position which is offset radially inwardly from a circumferential edge 132*b* of the end face 132*a*. Moreover, the derricking part 126 is formed to conform to the circumferential edge 132*b* of the end face 132*a*.

As illustrated in FIGS. 9A and 9B, the derricking part 126 has an inner wall surface 134*a* on the inner circumferential side, and an outer wall surface 134*b* on the outer circumferential side, as the side surfaces (circumferential surfaces) which form the convex shapes. The inner wall surface 134*a* and the outer wall surface 134*b* are formed as side surfaces (circumferential surfaces) which are substantially along the axial directions X. Moreover, the derricking part 126 has a tip-end face 134*c* between the inner wall surface 134*a* and the outer wall surface 134*b*. The tip-end face 134*c* is a surface substantially parallel to the end face 132*a*, and is located at the tip end of the outer cylinder 130 in the axial direction X. The derricking part 126 forms the step between the end face 132*a* and the tip-end face 134*c*.

Figure 10:
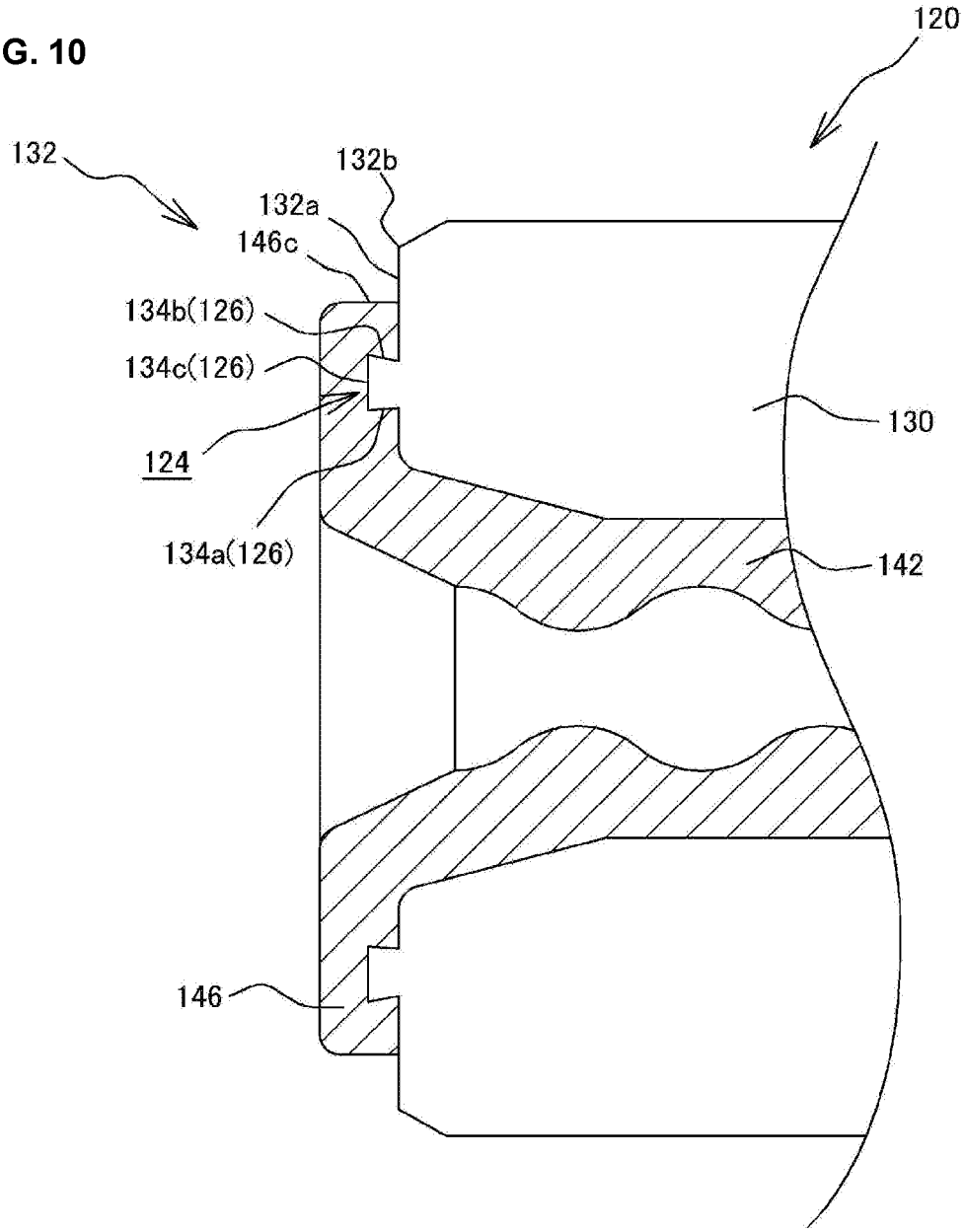
FIG. 10 is a cross-sectional view illustrating a substantial part of the stator of FIGS. 8A-8B.

As illustrated in FIG. 10 etc., the stator 120 is made in a state where the derricking part 126 is fitted into the gasket part 146. More specifically, as for the stator 120, the stator main body 142 is molded to the outer cylinder 130 so that it becomes in a form so that the derricking part 126 is fitted into a radially intermediate location of the gasket part 146. Moreover, in the stator 120, a circumferential surface 146*c* of the gasket part 146 is located radially outward of the outer cylinder 130 from the position at which the derricking part 126 is provided.

Next, a deformation control of the gasket parts 146 and 147 of the stator 120 is described. Note that, since the gasket parts 146 and 147 have similar structures, the gasket part 146 is described in the following description of this embodiment, and description of the gasket part 147 is omitted.

Similar to the stator 20 of the first embodiment, when the stator 120 is attached to the uniaxial eccentric screw pump 10, the gasket part 146 is pinched between the outer cylinder end 132 and the end stud 13, and becomes in a state where it is pressed from both sides in the axial directions X. The gasket part 146 tends to be elastically deformed radially outward of the stator 120 by receiving the pressing force from both sides in the axial directions X.

Here, the derricking part 126 of this embodiment demonstrates a function like an anchor at a radially intermediate location of the gasket part 146. Specifically, the derricking part 126 restricts a diameter increase of the gasket part 146 disposed inward of the inner wall surface 134*a*. Thus, the stator 120 can control that the adhesion of the fixing area 124 comes off by reducing the stress acting on the fixing area 124 where the gasket part 146 and the outer cylinder end 132 are adhered. Moreover, the stator 120 restricts the elastic deformation radially inward of the gasket part 146 by the outer wall surface 134*b* when removed from the uniaxial eccentric screw pump 10.

Thus, the stator 120 restricts the elastic deformation of the gasket part 146 which is expected when attaching and removing to/from the uniaxial eccentric screw pump 10. Moreover, the stator 120 restricts the elastic deformation of the gasket part 146 to reduce the stress of the fixing area 124 and prevent the peel-off of the outer cylinder 130 and the stator main body 142. As a result, damage of the stator 120 can be controlled.

Moreover, the stator 120 can make all or some area of the inner wall surface 134*a* and the outer wall surface 134*b* as the fixing area 124, in addition to the end face 132*a* and the tip-end face 134*c*. That is, the stator 120 can expand the adhesion area of the stator main body 142 and the outer cylinder end 132 by the area of the inner wall surface 134*a* and the outer wall surface 134*b* which constitute the circumferential surfaces (side surfaces) of the derricking part 126. Thus, as compared with the conventional stator 520, the adhesiveness of the gasket part 146 and the outer cylinder end 132 is improved, and the gasket part 146 peeling off from the outer cylinder end 132 can be prevented.

Third Embodiment

Next, a stator 220 according to a third embodiment of the present invention is described. Note that, in the following description, similar structures to the stator 20 are described using the same characters to omit detailed description thereof.

Figure 11:
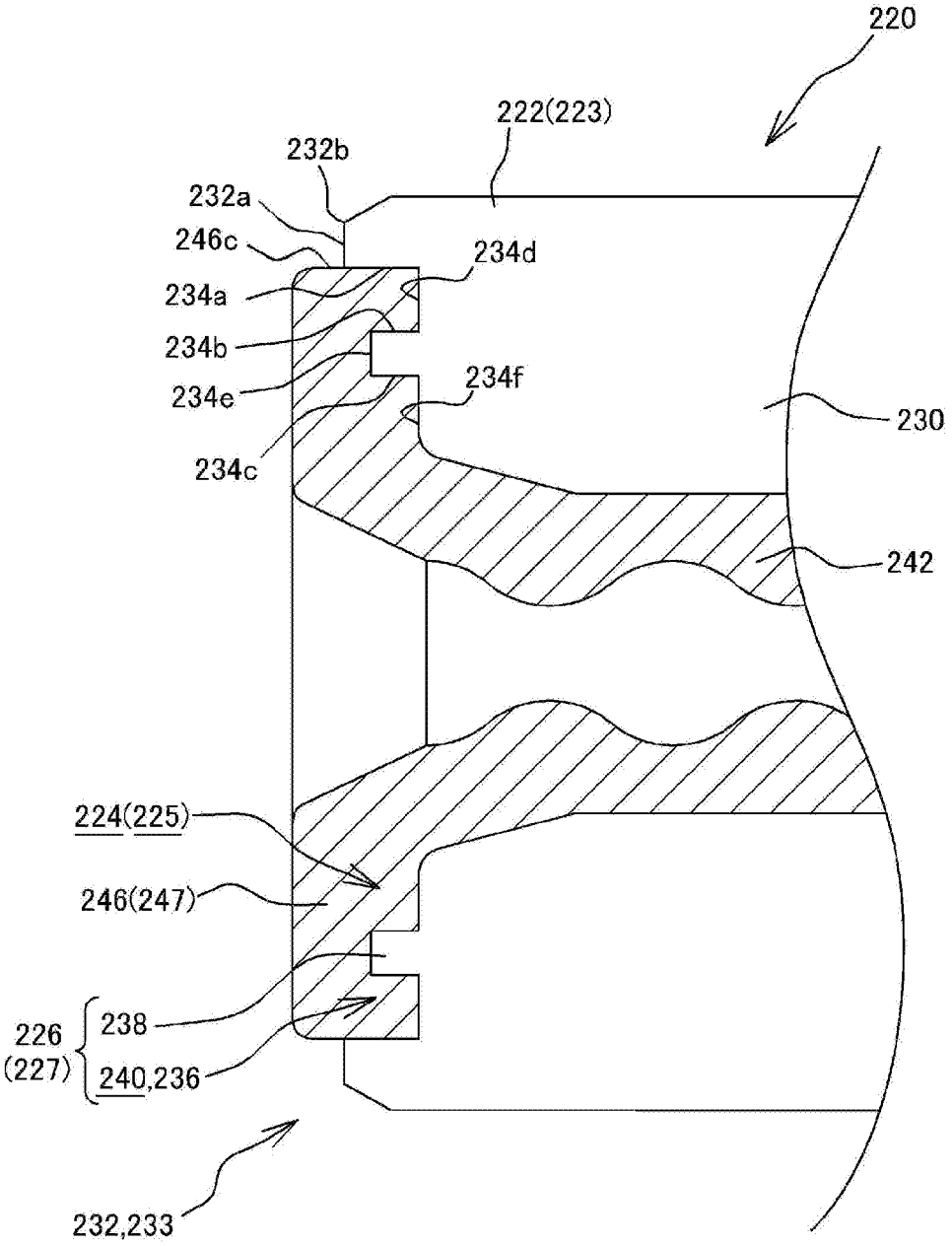
FIG. 11 is a cross-sectional view illustrating a substantial part of a stator according to a third embodiment of the present invention.

As illustrated in FIG. 11, the stator 220 has an outer cylinder 230 and a stator main body 242. The stator main body 242 has flange-shaped gasket parts 246 and 247 at both ends. Moreover, similar to the stator 20 of the first embodiment, as for the stator 220, the outer cylinder 230 and the stator main body 242 are integrally formed by the technique, such as pouring the molding material of the stator main body 242 into the outer cylinder 230 to which adhesives are adhered.

The stator 220 has stator ends 222 and 223 at both ends in the axial directions X. Fixing areas 224 and 225 are provided to the stator ends 222 and 223, respectively. Moreover, the outer cylinder 230 has outer cylinder ends 232 and 233 (ends) at both ends in the axial directions X. The stator 220 has the fixing areas 224 and 225 in contact parts of the outer cylinder ends 232 and 233 and the gasket parts 246 and 247, respectively. The stator 220 is formed by fixing the outer cylinder ends 232 and 233 and the gasket parts 246 and 247 by adhesives etc. in the fixing areas 224 and 225, respectively.

The stator 220 has derricking parts 226 and 227 at both ends in the axial directions X. The stator 220 has the derricking part 226 and the fixing area 224 at the stator end 222, and has the derricking part 227 and the fixing area 225 at the stator end 223. Note that, in the description of this embodiment, description of the derricking part 227, the outer cylinder end 233, the gasket part 247, and the fixing area 225 is omitted.

As illustrated in FIG. 11, the derricking part 226 is a part of concave and convex formed in the outer cylinder end 232. Specifically, the derricking part 226 is provided with a concave part 236 and a convex part 238 which are formed in the outer cylinder end 232. The derricking part 226 forms steps in the outer cylinder end 232 by a combination of the concave part 235 and the convex part 238. The concave part 236 is formed as a substantially circular depression which is dented from the end face 232*a* in the axial direction X. The convex part 238 is formed as an annular protruding part which protrudes in the axial direction X. Moreover, the convex part 238 is formed radially inward of the concave part 236. Moreover, the derricking part 226 is provided at a position radially offset inwardly from the circumferential edge 232*b* of the end face 232*a*. The derricking part 226 is formed so as to conform to the circumferential edge 232*b* of the end face 232*a*.

In the stator 220, the gasket part 246 is made into a derricking shape (concavo-convex shape) corresponding to the shapes of the concave part 235 and the convex part 238. Specifically, the gasket part 246 is made into a convex shape which protrudes in the axial direction X toward the outer cylinder end 232 at a position corresponding to the concave part 235. Moreover, the gasket part 246 is made into a concave shape which is dented in the axial direction X at a position corresponding to the convex part 238. Thus, the stator 220 is made into such a shape that the concavo-convex parts (derricking part) of the outer cylinder end 232 and the gasket part 246 are mutually fitted in the axial directions X in the part where the derricking part 226 is provided.

Further describing the derricking part 226 in detail, as illustrated in FIG. 11, the derricking part 226 has a plurality of side surfaces (circumferential surfaces) which form the concavo-convex shape. Specifically, the derricking part 226 has a first wall surface 234*a* as an inner circumferential surface which forms the concave part 236. Moreover, the derricking part 226 has a second wall surface 234*b* on the outer circumferential side and a third wall surface 234*c* on the outer circumferential side, as the side surfaces (circumferential surfaces) which form the convex part 238. The first wall surface 234*a* and the third wall surface 234*c* are formed as side surfaces which face radially inward of the outer cylinder 230. Moreover, the second wall surface 234*b* is formed as a side surface which faces radially outward of the outer cylinder 230.

Moreover, the derricking part 226 has a first bottom surface 234*d*, a top surface 234*e*, and a second bottom surface 234*f*, as surfaces substantially parallel to the end face 232*a*. The first bottom surface 234*d* is formed between the first wall surface 234*a* and the second wall surface 234*b*. The top surface 234*e* is formed between the second wall surface 234*b* and the third wall surface 234*c*. The second bottom surface 234*f* is formed inside the third wall surface 234*c*. The derricking part 226 forms steps between the end face 232*a*, and the first bottom surface 234*d* and the second bottom surface 234*f*.

As illustrated in FIG. 11, the concave part 236 is formed inside the first wall surface 234*a*. Moreover, an accommodation area 240 is formed in the concave part 236. The accommodation area 240 is capable of accommodating part of the gasket part 246 in the axial directions X. In a state where the stator main body 242 is molded to the outer cylinder 230, the gasket part 246 becomes in a state where the entire area in the radial directions but the part in the axial directions X is accommodated in the accommodation area 240. Moreover, the convex part 238 becomes in a state where it protrudes in the axial direction X with respect to the gasket part 246 accommodated in the accommodation area 240. Thus, the stator 220 is structured such the outer cylinder end 232 and the gasket part 246 are mutually fitted in the state where the stator main body 242 is formed in the outer cylinder 230.

When the stator 220 is attached to the uniaxial eccentric screw pump 10, the gasket part 246 is pinched between the outer cylinder end 232 and the end stud 13, and becomes in a state where it is pressed from both sides in the axial directions X. The gasket part 246 tends to be elastically deformed radially outward of the stator 220 by receiving the pressing force from both sides in the axial directions X. The stator 220 restricts the radial elastic deformation of the gasket part 246 by the first wall surface 234*a* contacting the circumferential surface 246*c* of the gasket part 246 from radially outward. Moreover, the convex part 238 demonstrates a function like an anchor at a radially intermediate location to the gasket part 246 accommodated in the accommodation area 240. Thus, the stator 220 restricts the radially-outward and radially-inward elastic deformations of the gasket part 246 at an intermediate location of the gasket part 246, while restricting the radially-outward elastic deformation of the gasket part 246. That is, the stator 220 performs the dual-restriction of the elastic deformation of the gasket part 246. Thus, the stator 220 can prevent that the gasket part 246 peels off from the outer cylinder end 232 due to the elastic deformation of the gasket part 246.

Moreover, in the process of forming the stator main body 242 to the outer cylinder 230, the stator 220 is capable of using the first wall surface 234*a*, the second wall surface 234*b*, and the third wall surface 234*c* as the fixing area 224, in addition to the first bottom surface 234*d*, the top surface 234*e*, and the second bottom surface 234*f*. That is, the stator 220 is capable of expanding the adhesion area of the gasket part 246 and the outer cylinder end 232 by the area of the first wall surface 234*a*, the second wall surface 234*b*, and the third wall surface 234*c* which constitute the circumferential surface (side surface) of the derricking part 226. Thus, the stator 220 is capable of improving the adhesiveness of the gasket part 246 and the outer cylinder end 232 to prevent that the gasket part 246 peels off from the outer cylinder end 232.

As described above, although the first embodiment, the second embodiment, and the third embodiment of the present invention are described and the derricking parts of the stators 20, 120, and 220 are described in detail, the stator of the present invention is not limited to these structures.

Although the wall surface 34*a* having the shape which curves in the axial directions X is described in the description of the first embodiment and the inner wall surface 134*a* and the outer wall surface 134*b* which are formed along the axial directions X are described in the second embodiment, the shapes of the wall surfaces which the derricking part of the present invention has is not limited to these structures.

Figure 12A:
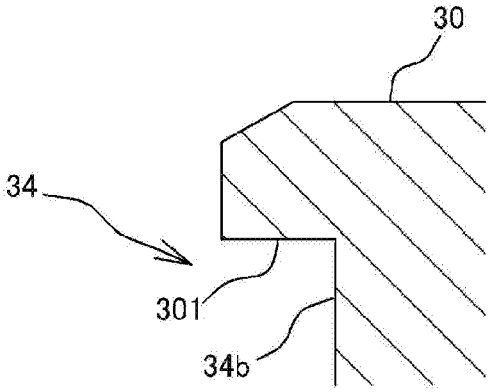
FIGS. 12A-12C one example of a wall surface of the stator of the present invention, where
Figure 12B:
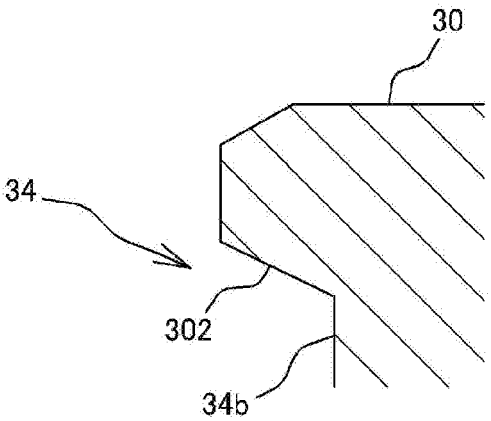
Figure 12C:
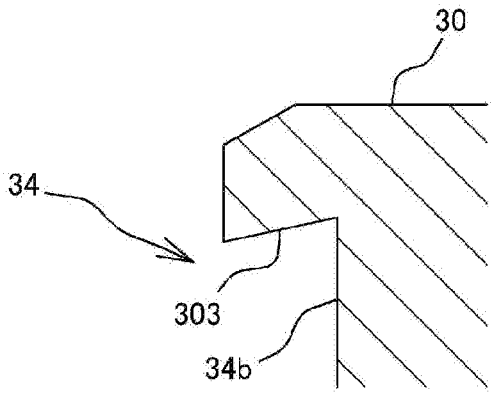

For example, as illustrated in FIG. 12A, the wall surface which the stator of the present invention has may be a wall surface 301 which is formed so as to be substantially perpendicular to the bottom surface 34*b*, instead of the wall surface 34*a* having the curved surface of the first embodiment. Moreover, as illustrated in FIG. 12B, the wall surface which the stator of the present invention has may be a wall surface 302 which has the shape inclined to the axial directions X and is formed to have an obtuse angle to the bottom surface 34*b*, instead of the wall surface 34*a*. Alternatively, the wall surface which the stator of the present invention has may be a wall surface 303 which is formed to have an acute angle to the bottom surface 34*b*, as illustrated in FIG. 12C.

Further, the wall surface which the stator of the present invention has may be structured to be a wall surface substantially perpendicular to the bottom surface similar to the wall surface 301 illustrated in FIG. 12A, instead of the inner wall surface 134*a* and the outer wall surface 134*b* in the second embodiment, or may be structured to be a wall surface which curves with respect to the axial directions X. Further, the wall surface which the stator of the present invention has may be a surface which inclines to the axial directions X or a surface which curves with respect to the axial directions X, instead of the wall surfaces of the first wall surface 234*a*, the second wall surface 234*b*, and the third wall surface 234*c* in the third embodiment. In any case, various shapes may be selected for the wall surface.

Further, in the first embodiment, although the stator 20 having the derricking part 26 having the concave shape (concave part) made into the circular depression shape is described, the stator of the present invention is not limited to this structure. For example, the stator of the present invention may be a derricking part 312 made into an annular groove as illustrated FIGS. 13A-1 and 13A-2.

Moreover, as illustrated in FIGS. 13B-1 and 13B-2, the stator of the present invention may be structured such that a stator main body 322 is molded to the outer cylinder 130 described in the second embodiment. Specifically, the stator of the present invention may be structured such that the stator main body 322 is molded to the outer cylinder 130 so that the gasket part 324 is accommodated radially inward of the derricking part 126 (convex part).

Further, in the description of each embodiment for the stator of the present invention described above, although the derricking part having one concave part or one convex part, or both the concave part and the convex part are described, the stator of the present invention is not limited to this structure.

For example, the stator of the present invention may have a derricking part provided with two convex parts, like a stator 330 illustrated in FIG. 14A. Moreover, the stator of the present invention may have a derricking part provided with one convex part and one concave part, like a stator 340 illustrated in FIG. 14B. Further, the stator of the present invention may have a derricking part provided with two convex parts, like a stator 350 illustrated in FIG. 14C. Alternatively, the stator of the present invention may be provided with two wall surfaces which are formed so as to incline to the axial directions X, and have a derricking part which does not form the stepped shape, like a stator 360 illustrated in FIG. 14D.

In any case, the derricking part of the stator of the present invention may be any shape, as long as it is such a shape that at least one of the outer cylinder and the stator main body is fitted into the other.

Further, although in each embodiment of the stator of the present invention described above the outer cylinders 30, 130, and 230 having the circular cross-sectional shape, and the stators 20, 120, and 220 having the derricking parts 26, 134, and 234 having the circular or annular concave part or convex part are described, respectively, the outer cylinder and the derricking part which the stator of the present invention has are not limited to these structures.

Figure 15A:
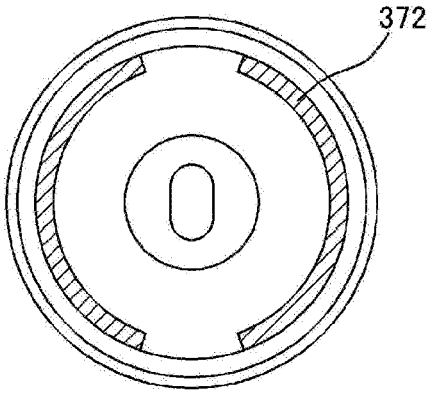
Figure 15B:
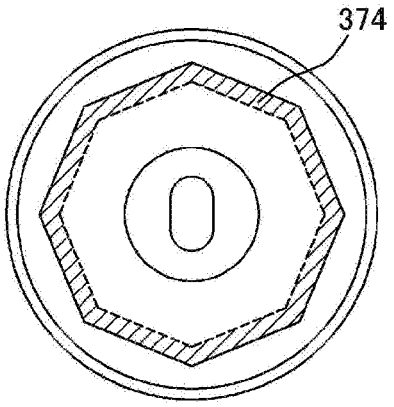
Figure 15C:
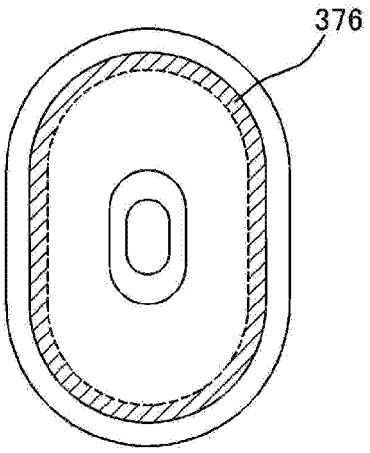
Figure 16:
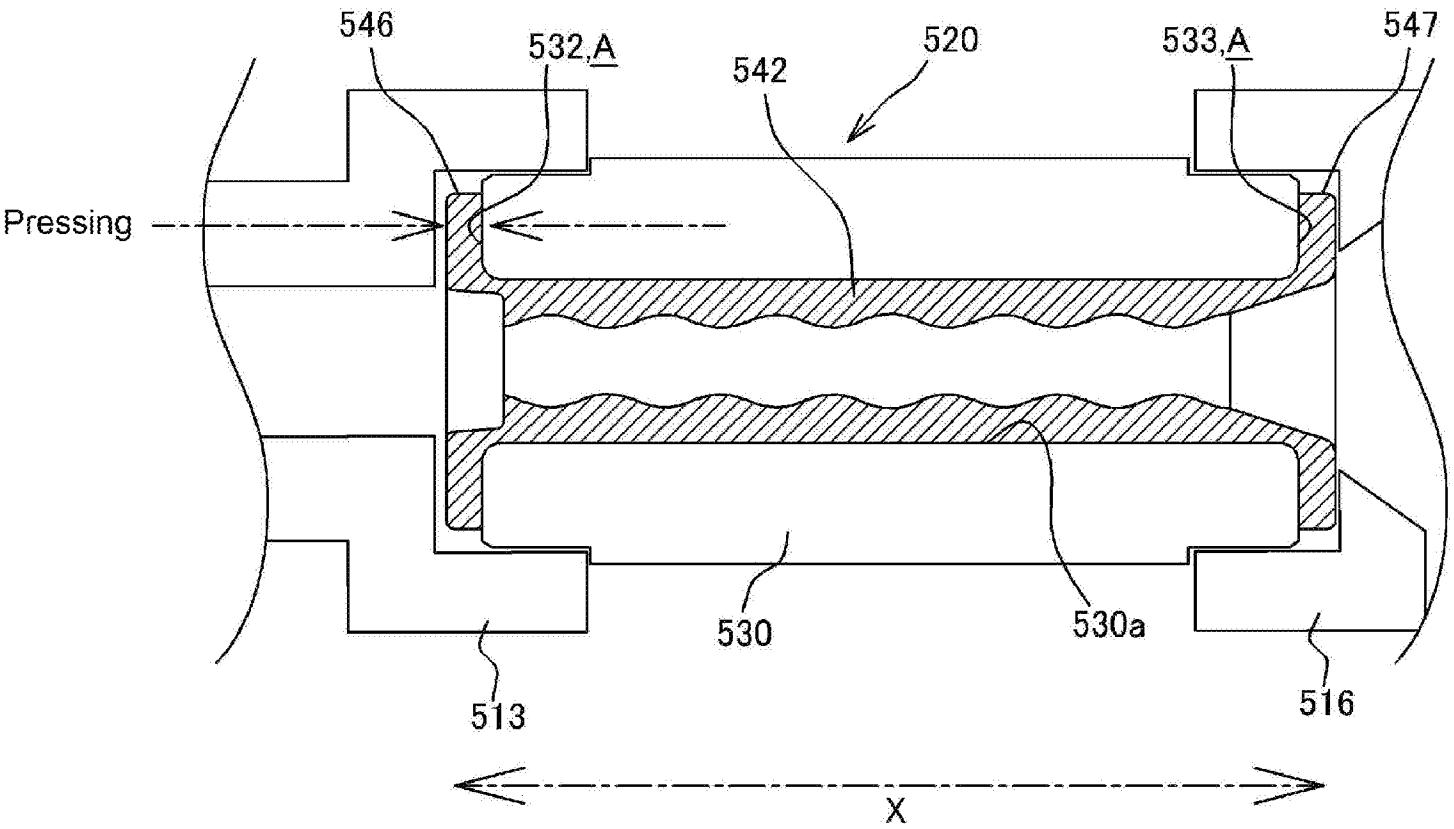
FIG. 16 is a conceptual view illustrating a state where a conventional stator is attached to the uniaxial eccentric screw pump.
Figure 17:
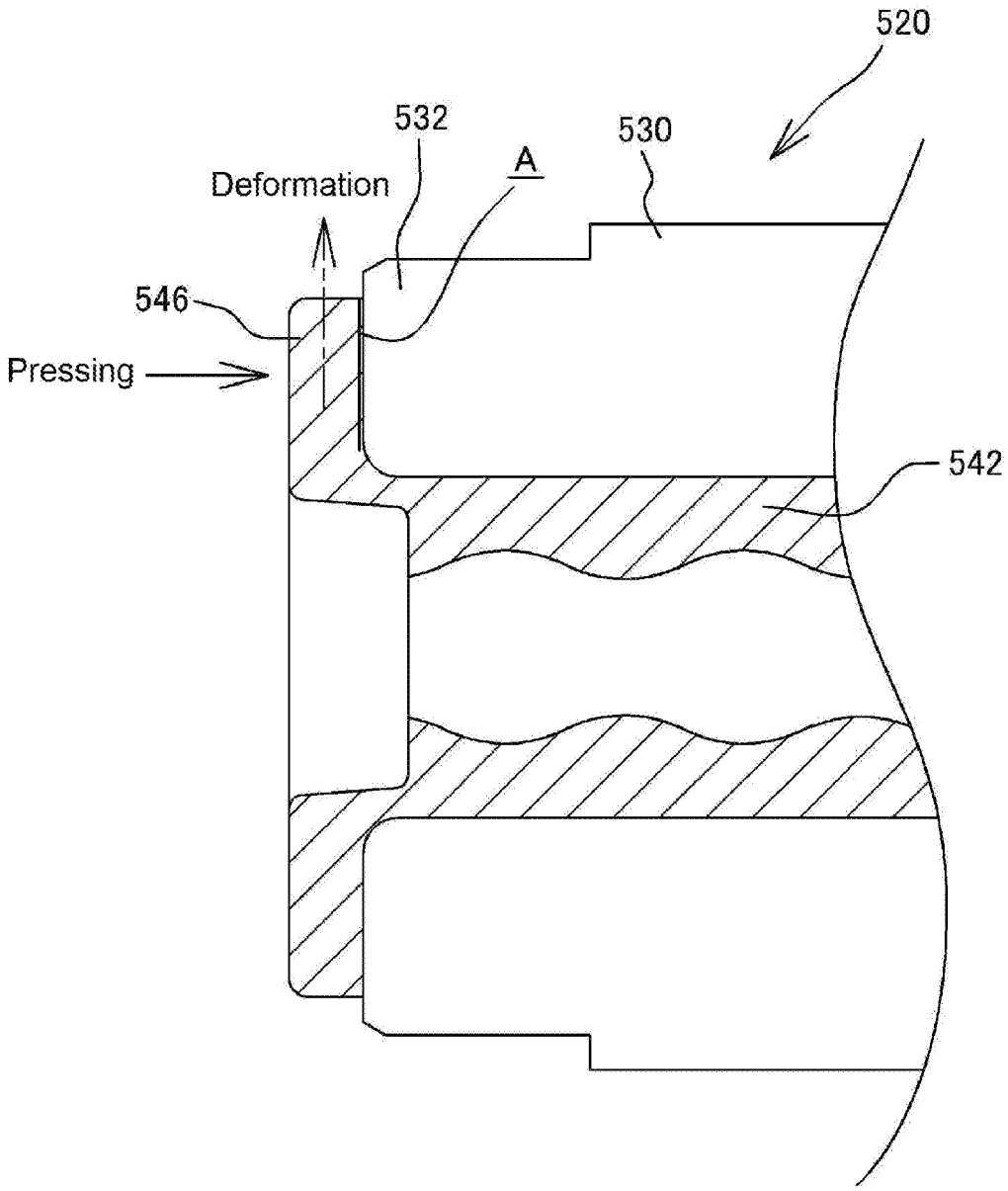
FIG. 17 is a cross-sectional view illustrating a substantial part of the stator of FIG. 16.
Figure 18:
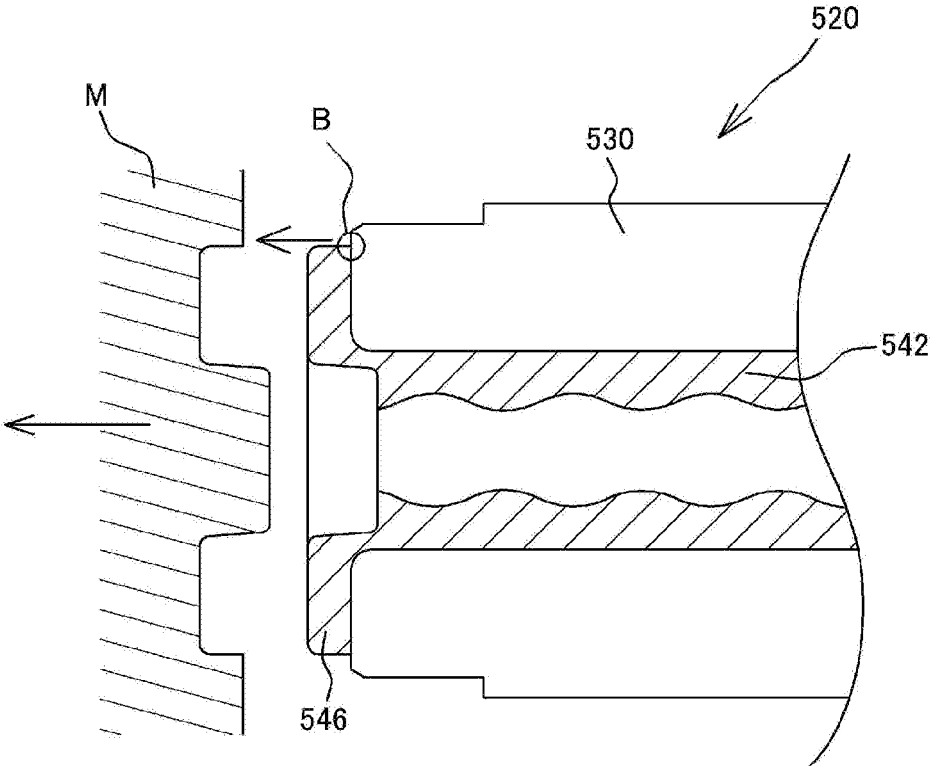
FIG. 18 is a cross-sectional view illustrating the stator of FIG. 16 when released from a mold in a molding process.

For example, as illustrated in FIG. 15A, the stator of the present invention may have a derricking part 372 made into the concave part or the convex part having an annular shape where a part of which is divided, along the outer edge of the outer cylinder end. Alternatively, the stator of the present invention may have a derricking part made into the annular concave part or convex part formed partially along the outer edge of the outer cylinder end. Moreover, as illustrated in FIG. 15B, the stator of the present invention may have a derricking part 374 made into a depression or a convex part having a polygonal shape formed along the outer edge of the outer cylinder end. Further, as illustrated in FIG. 15C, if the outer cylinder and the stator main body have the oval cross-sectional shape, the stator of the present invention may have a derricking part 376 made into an oval depression or convex part along the outer edge of the outer cylinder end. Further, if the outer cylinder has the circular cross-sectional shape and the stator main body has the polygonal shape, such as the substantially triangular shape, the stator of the present invention may be suitably selectable of a derricking part made into a shape which conforms to the shape of the gasket part formed in the stator main body.

Moreover, the stator of the present invention may be provided with the derricking part in one of the both ends in the axial directions X. Further, the stator of the present invention may be provided with derricking parts having different shapes in the both ends in the axial directions X. For example, in the stator of the present invention, the derricking part in one of the both ends may be the concave part, and the derricking part in the other end may be the convex part.

Moreover, as for the stator of the present invention, the materials of the outer cylinder and the stator main body may be suitably selectable in accordance with the type, property, etc. of the transferring object which is the object to be conveyed by using the uniaxial eccentric screw pump 10.

The stator of the present invention can be suitably used for the uniaxial eccentric screw pump or an application device which uses the uniaxial eccentric screw pump.

DESCRIPTION OF REFERENCE CHARACTERS

10 Uniaxial Eccentric Screw Pump
20 Stator
24, 25 Fixing Area
26, 27 Derricking Part (Concave Part)
32, 33 Outer Cylinder End Part (End Part of Outer Cylinder)
34*a*, 35*a* Wall Surface
36, 37 Accommodation Area
42 Stator Main Body
42*a* Inner Circumferential Surface
46, 47 Gasket Part
46*c* Circumferential Surface
48 Insertion Hole
50 Rotor
120 Stator
122, 123 Stator End Part
124, 125 Fixing Area
126, 127 Derricking Part (Convex Part)
132, 133 Outer Cylinder End Part (End Part of Outer Cylinder)
142 Stator Main Body
146, 147 Gasket Part
146*c* Circumferential Surface
220 Stator
224, 225 Fixing Area
226, 227 Derricking Part (Concave Part, Convex Part)
230 Outer Cylinder
232, 233 Outer Cylinder End Part (End Part of Outer Cylinder)
234*a* First Wall Surface (Wall Surface)
234*b* Second Wall Surface (Wall Surface)
234*c* Third Wall Surface (Wall Surface)
236 Concave Part
238 Convex Part
240 Accommodation Area
242 Stator Main Body
246, 247 Gasket Part
246*c* Circumferential Surface
301, 302, 303 Wall Surface
310 Stator
312 Derricking Part
322 Stator Main Body
324 Gasket Part
330 Stator
340 Stator
350 Stator
360 Stator
372 Derricking Part
374 Derricking Part
376 Derricking Part
X Axial Directions

What is claimed is:

1. A stator of a uniaxial eccentric screw pump structured so that an externally threaded rotor is rotatably inserted into the stator formed with an internally-threaded insertion hole, and a transferring object is transferred by eccentrically rotating the rotor via a drive source, comprising:

a stator main body, molded with elastomer, and formed in an inner circumferential surface thereof with the internally-threaded insertion hole extending in axial directions of the stator; and an outer cylinder attached externally to the stator main body, wherein the stator main body includes a flange-shaped gasket part in at least one end thereof, wherein the gasket part has a circumferential surface located radially outwardly, wherein at least a part of the circumferential surface of the gasket part is arranged so as to be exposed to a space on radially outward, wherein the stator includes a fixing area to which the gasket part and the outer cylinder are adhered, wherein one or both of the outer cylinder and the gasket part has a derricking part protruding or being dented in the axial directions of the stator, wherein the derricking part is made into such a shape that at least part of one of the outer cylinder and the gasket part is fitted into the other, wherein the stator has the derricking part at least one of both ends of the stator, wherein the fixing area are provided in the derricking part; and wherein the gasket part is configured so that a deformation of one part of the gasket part in a direction intersecting with the axial directions due to a pressure in the axial directions of the stator is prevented in the fixing area, while other part of the gasket part in the space for which a deformation in a direction intersecting with the axial directions is not prevented deforms radially outward of the fixing region toward the inside of the space to which the circumferential surface is exposed;

wherein the derricking part provided to the end of the outer cylinder is the outer cylinder end having a step in the axial direction of the stator.

2. The stator of claim 1, comprising a wall surface that forms a side surface of the derricking part provided to the end of the outer cylinder, wherein the wall surface restricts the deformation in a direction intersecting with the axial directions of the stator in the gasket part.

3. The stator of claim 1, comprising a wall surface that forms a side surface of the derricking part provided to the end of the outer cylinder, wherein all or part of the wall surface is formed so as to conform to all or part of the contour of the circumferential surface of the gasket part.

4. The stator of claim 1, comprising a wall surface that forms a side surface of the derricking part provided to the end of the outer cylinder, wherein all or part of the wall surface is arranged so as to oppose to at least part of the circumferential surface of the gasket part.

5. The stator of claim 1, comprising a wall surface that forms a side surface of the derricking part provided to the end of the outer cylinder, wherein all or part of the wall surface is arranged so as to surround the circumferential surface of the gasket part.

6. The stator of claim 1, comprising:

a wall surface that forms a side surface of the derricking part provided to the end of the outer cylinder; and an accommodation area structured inside the wall surface, wherein all or part of the wall surface is arranged so as to surround the circumferential surface of the gasket part, and wherein the gasket part has a part accommodated in the accommodation area, and a part protruded in the axial direction of the stator from the accommodation area.

7. The stator of claim 1, wherein the derricking part provided to the end of the outer cylinder is provided with one or both of a concave part formed in a concave in the axial direction of the stator and a convex part formed in a convex.

8. The stator of claim 1, wherein the gasket part and the outer cylinder are fixed by adhesion with adhesives or pressure joining by heat.

9. A uniaxial eccentric screw pump comprising the stator of claim 1.

* * * * *